US008888532B2

(12) United States Patent
Hamaoka et al.

(10) Patent No.: US 8,888,532 B2
(45) Date of Patent: Nov. 18, 2014

(54) CONNECTOR FOR MOUNTING ELECTROLYTIC CAPACITOR ONTO BOARD AND ELECTRONIC CIRCUIT APPARATUS

(75) Inventors: Yuji Hamaoka, Tokyo (JP); Akira Ohno, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 196 days.

(21) Appl. No.: 13/510,453

(22) PCT Filed: Oct. 21, 2010

(86) PCT No.: PCT/JP2010/068595

§ 371 (c)(1),
(2), (4) Date: May 17, 2012

(87) PCT Pub. No.: WO2011/065159

PCT Pub. Date: Jun. 3, 2011

(65) Prior Publication Data

US 2012/0238140 A1 Sep. 20, 2012

(30) Foreign Application Priority Data

Nov. 24, 2009 (JP) ..... 2009-265956

(51) Int. Cl.
*H01R 13/66* (2006.01)
*H01R 12/72* (2011.01)

(52) U.S. Cl.
CPC ..... *H01R 13/6625* (2013.01); *H01R 12/724* (2013.01)
USPC ..... 439/620.24

(58) Field of Classification Search
USPC ..... 439/620.24, 76.2; 361/714, 699
See application file for complete search history.

(56) References Cited

U.S. PATENT DOCUMENTS

| | | | | |
|---|---|---|---|---|
| 6,368,148 | B1 | 4/2002 | Fogg et al. | |
| 2002/0106939 | A1* | 8/2002 | Beuther et al. | 439/620 |
| 2003/0067749 | A1* | 4/2003 | Tamba et al. | 361/699 |
| 2004/0235317 | A1* | 11/2004 | Schiefer | 439/76.2 |
| 2008/0294324 | A1* | 11/2008 | Yoshinari et al. | 701/102 |

FOREIGN PATENT DOCUMENTS

| | | |
|---|---|---|
| JP | 56-052875 | 5/1981 |
| JP | 59-49378 | 4/1984 |

(Continued)

OTHER PUBLICATIONS

International Search Report of PCT/JP2010/068595, date of mailing Nov. 16, 2010.

*Primary Examiner* — Jean F Duverne
(74) *Attorney, Agent, or Firm* — Collard & Roe, P.C.

(57) ABSTRACT

It is an object of the present invention to provide an electronic circuit apparatus in which mounting efficiency and connection stability of an electrolytic capacitor are compatible. An electronic circuit apparatus 5 of the present invention includes a board 60 with a circuit element 70 mounted thereto, a case 80 holding and surrounding the board 60, and a board mount connector (connector for mounting the electrolytic capacitor onto the board) 1 mounted onto the board 60 and holding the electrolytic capacitor 20. The board mount connector 1 includes a board connector 30 to be mounted onto the board and a holder 10 connected to the board connector 30 and holding the electrolytic capacitor 20 as an insulating holding body. The electrolytic capacitor 20 is mounted onto the board 60 via the board mount connector 1 by mounting the board connector 30 onto the board 60.

22 Claims, 28 Drawing Sheets

(56) References Cited

FOREIGN PATENT DOCUMENTS

| | | |
|---|---|---|
| JP | 63-157180 | 10/1988 |
| JP | 6-152116 | 5/1994 |
| JP | 9-186421 | 7/1997 |
| JP | 10-335013 | 12/1998 |
| JP | 2002-170640 | 6/2002 |
| JP | 2008-244033 | 10/2008 |
| WO | WO 2008/047571 | 4/2008 |

* cited by examiner

CONNECTOR FOR MOUNTING ELECTROLYTIC CAPACITOR ONTO BOARD AND ELECTRONIC CIRCUIT APPARATUS

CROSS REFERENCE TO RELATED APPLICATIONS

This application is the National Stage of PCT/JP2010/068595 filed on Oct. 21, 2010, which claims priority under 35 U.S.C. §119 of Japanese Application No. JP 2009-265956 filed on Nov. 24, 2009, the disclosure of which is incorporated by reference. The international application under PCT article 21(2) was not published in English.

TECHNICAL FIELD

The present invention relates to a connector for mounting an electrolytic capacitor onto a board and an electronic circuit apparatus.

BACKGROUND ART

In an electronic circuit apparatus in which a board mounted with circuit elements is covered with a case at its periphery, in case where an electrolytic capacitor is used as a circuit element, for example, such as in an ECU (electronic control unit) of an airbag for automobile use, the electrolytic capacitor is often larger in external size as compared with other circuit elements. Accordingly, when the electrolytic capacitor is directly mounted to the board, mounting efficiency is degraded.

Therefore, in order to improve the mounting efficiency, there is a structure in which a body portion (cylindrical portion) of the electrolytic capacitor is mounted in a floating state above the board and arranged transversely so that other circuit elements are mounted under the electrolytic capacitor.

In the above-mentioned structure, the electrolytic capacitor has conventionally been mounted by directly soldering a lead of the electrolytic capacitor to a through hole formed on the board or inserting the lead of the electrolytic capacitor into a connector mounted on the board (for example, Patent Documents 1 and 2).

PRIOR ART DOCUMENTS

Patent Documents

Patent Document 1: JP-A-H06-152116
Patent Document 2: JP-A-H09-186421

SUMMARY OF THE INVENTION

Problem to be Solved by the Invention

However, in the mounting method disclosed in Patent Document 1 or 2, the body portion of the electrolytic capacitor is supported at a lead portion having relatively low strength. Thus, in case of the above-mentioned electronic circuit apparatus for automobile use, stress due to vibration is concentrated at a connecting portion of the lead, resulting in connection failure with the board, a breakage of the lead, and so on. Thus, there is a problem that connection stability is poor.

In view of the above-mentioned problem, it is an object of the present invention to provide an electronic circuit apparatus in which mounting efficiency and connection stability of an electrolytic capacitor are compatible.

Means to Solve the Problems

In order to achieve the above-mentioned object, the first invention is a board mount connector for mounting an electrolytic capacitor, comprising a holder comprising a fitting portion, an insulating holding portion for holding the electrolytic capacitor, and a first terminal provided in the holding portion and adapted to be electrically connected to a lead of the electrolytic capacitor; and a board connector comprising an insulating housing provided with a holder fitting portion to be fitted to the fitting portion, and a second terminal provided in the housing and adapted to connect the first terminal to a board.

The second invention is an electronic circuit apparatus comprising a board mounted with a circuit element and a case holding and surrounding the board, the board being mounted with the board mount connector for mounting an electrolytic capacitor according to the first invention in the state where the electrolytic capacitor is held, the electrolytic capacitor being mounted to the board through the board mount connector.

Thus, the present invention solves the above-mentioned problem by mounting the electrolytic capacitor to the board by making the holder hold the electrolytic capacitor and by fitting and attaching the holder to the board connector mounted on the board.

Effect of the Invention

According to the present invention, a body portion of the electrolytic capacitor and the lead wire are held and fixed by the holder and the holder is fitted and attached to the board connector. Therefore, stress due to vibration does not reach the lead and the connecting portion thereof. Thus, it is possible to obtain a stable connection state of the electrolytic capacitor with the board.

According to the present invention, the holder can be fitted and connected to the board connector in the state where the electrolytic capacitor held by the holder is arranged transversely in a floating state above a circuit element mounting portion. Therefore, mounting efficiency of a circuit on the board is improved as compared with the case where the electrolytic capacitor is directly connected onto the board. Accordingly, it is possible to achieve reduction in size of the board and reduction in size of the electronic circuit apparatus.

Thus, according to the present invention, it is possible to provide an electronic circuit apparatus in which mounting efficiency and connection stability of an electrolytic capacitor are compatible.

According to the present invention, the electrolytic capacitor is held by the holder and fitted and attached to the board connector. With this structure, the electrolytic capacitor is easily replaced in case of occurrence of failure in the electrolytic capacitor or the like, as compared with the case where the electrolytic capacitor is directly mounted.

According to the present invention, the holder fitting portion of the board connector may be arranged to face an opening portion of the case so that the holder can be fitted and attached from the outside of the case. Therefore, the capacitor can easily be replaced from the outside of the case without disassembling the case.

According to the present invention, the board connector and an input/output connector can be integrally formed. Therefore, it is possible to easily repair the capacitor from the outside of the case without disassembling the case.

According to the present invention, the board connector and the input/output connector can be integrally formed. Therefore, it is possible to reduce the number of components of the electronic circuit apparatus and to achieve reduction in size of the apparatus and improvement in connector mounting workability.

MODE FOR EMBODYING THE INVENTION

Figure 1:
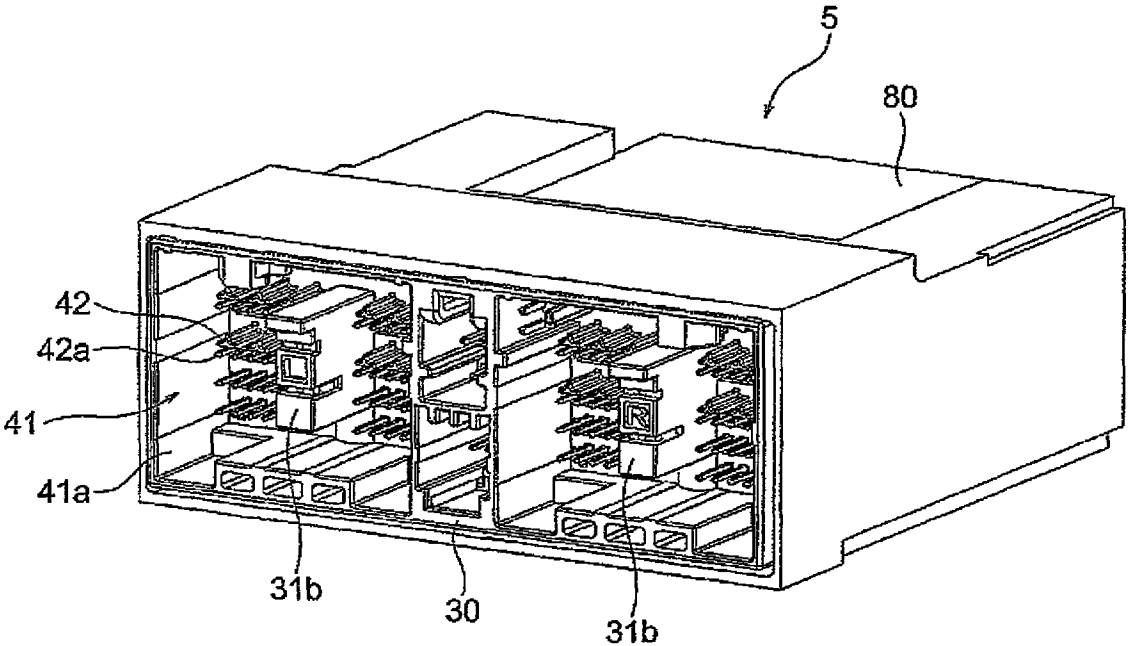
FIG. 1 is a perspective view of an electronic circuit apparatus 5.

Now, preferred embodiments of the present invention will be described in detail with reference to the drawing.

At first, referring to FIGS. 1 to 15, description will be made about the structure of an electronic circuit apparatus 5 mounted with a board mount connector 1, according to a first embodiment of the present invention, for mounting an electrolytic capacitor onto a board.

Herein, as the electronic circuit apparatus 5, an ECU of an airbag for automobile use is shown by way of example but the present invention is not limited thereto.

Figure 2:
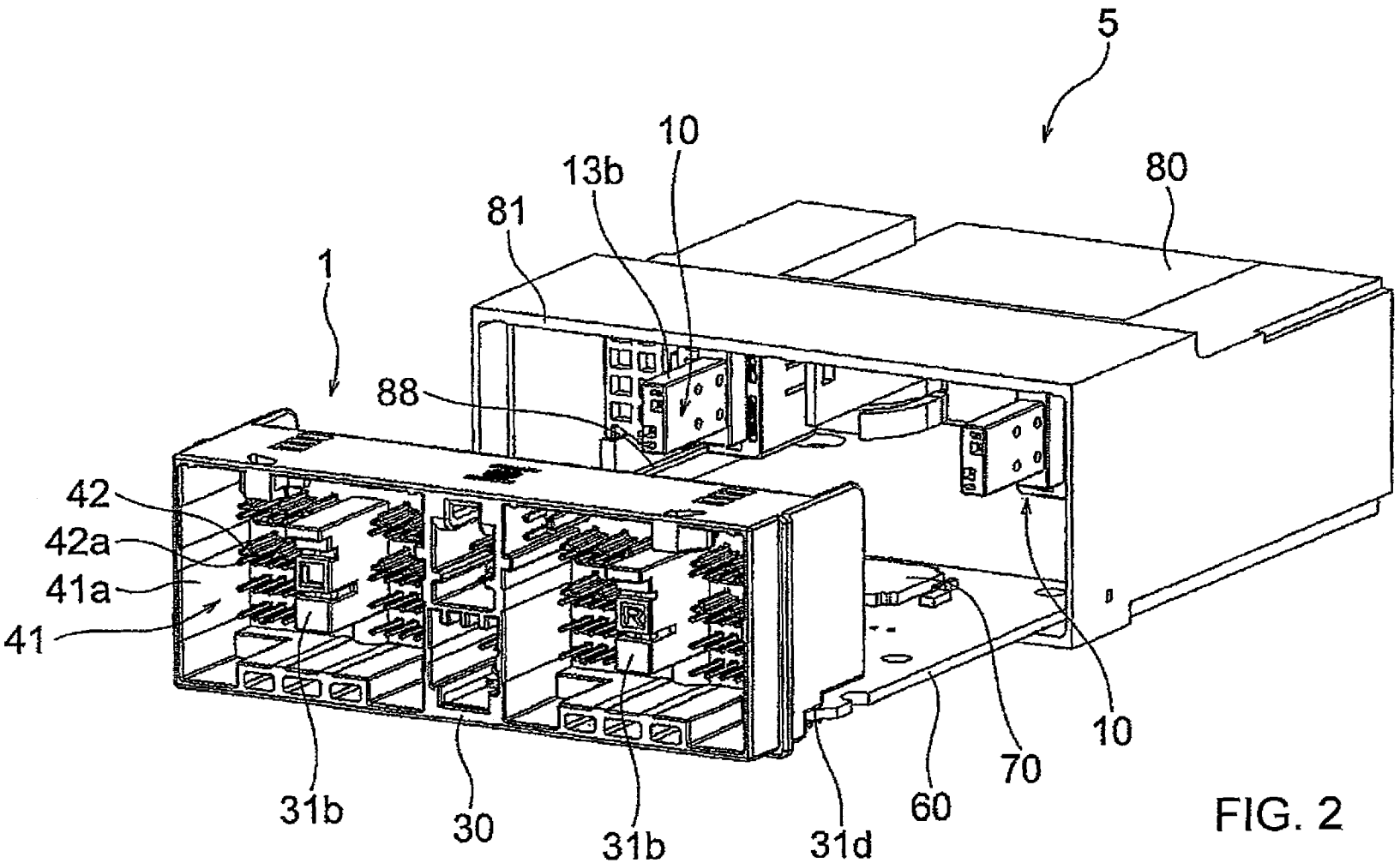
FIG. 2 is an exploded perspective view of the electronic circuit apparatus 5.
Figure 3:
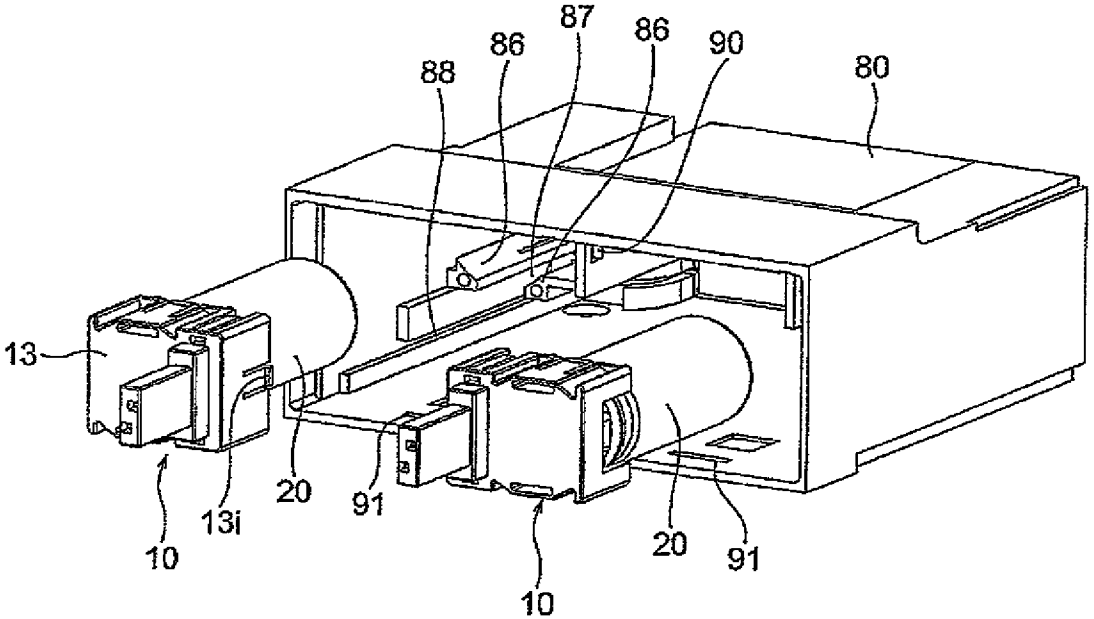
FIG. 3 is an exploded perspective view of the electronic circuit apparatus 5.

As illustrated in FIGS. 1 to 3, the electronic circuit apparatus 5 comprises a board 60 with circuit elements 70 mounted thereto, a case 80 holding and surrounding the board 60, and the board mount connector 1 (connector for mounting the electrolytic capacitor onto the board) mounted to the board 60 and holding electrolytic capacitors 20. The board mount connector 1 comprises a board connector 30 to be mounted to the board 60 and holders 10 as insulating holding members connected to the board connector 30 and adapted to hold the electrolytic capacitors 20. By mounting the board connector 30 to the board 60, the electrolytic capacitor 20 is mounted to the board 60 via the board mount connector 1.

Next, referring to FIGS. 4 to 9, description will be made in detail about structures of the electronic circuit apparatus 5 and the board mount connector 1.

At first, referring to FIGS. 4 to 7, the structure of the holder 10 of the board mount connector 1 will be described in detail.

As illustrated in FIGS. 4 to 7, the holder 10 comprises a holding member 11 holding the electrolytic capacitor 20 and first terminals 14 held by the holding member 11.

Figure 5:
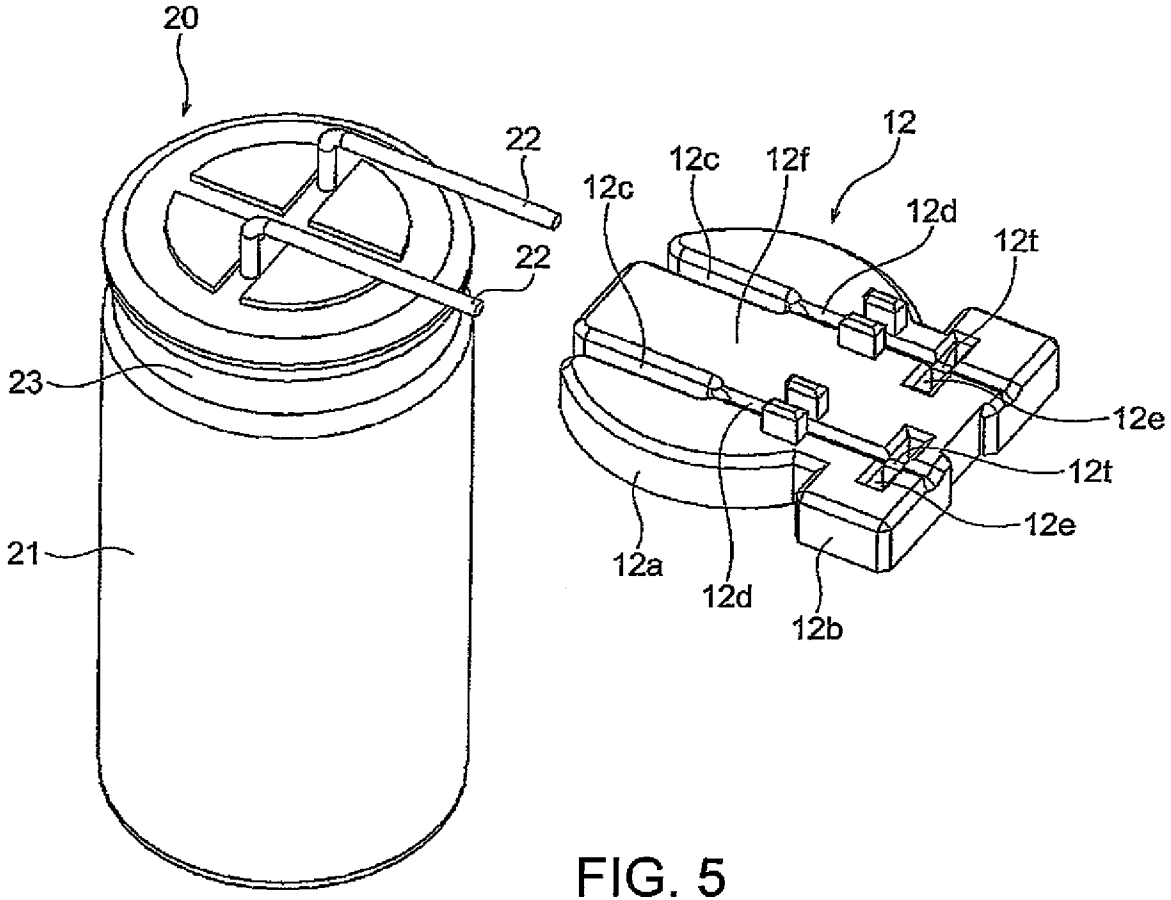
FIG. 5 is a perspective view of a first part 12 and the electrolytic capacitor 20.

As illustrated in FIG. 5, the electrolytic capacitor 20 is of a type comprising a cylindrical body portion 21 and a pair of leads 22 projecting from one end face of the body portion 21.

The holding member 11 comprises a first part 12 (base housing) and a second part 13 (cap housing) which are adapted to be fixed to each other.

As illustrated in FIG. 5, the first part 12 has a plate-like shape and comprises a circular portion 12*a* substantially similar in shape to an end face of the electrolytic capacitor 20 and a rectangular portion 12*b* formed at a peripheral edge of the circular portion.

As will be described later, the first part 12 is coupled to the electrolytic capacitor 20 by bringing one surface of the circular portion 12*a* into contact with the end face of the electrolytic capacitor 20 from which the leads 22 are projected.

The first part 12 will be described more in detail. The circular portion 12*a* of the first part 12 is provided with penetrating grooves 12*c* for extracting the leads 22 onto the other surface 12*f* (a surface opposite to the surface brought into contact with the electrolytic capacitor 20, that is, a first surface) of the circular portion 12*a* and lead holding grooves 12*d* connected to the penetrating grooves 12*c* and extending on the other surface 12*f* from the circular portion 12*a* towards the rectangular portion 12*a*.

With the above-mentioned structure, the leads 22 are inserted into the penetrating grooves 12*c* and then received in and held by the lead holding grooves 12*d* in the state where the leads are perpendicularly bent at an extracting portion.

The rectangular portion 12*b* comprises press-contacting piece receiving grooves 12*e* which intersect with the lead holding grooves 12*d* and which penetrate from the other surface 12*f* to the contacting surface. At an intersecting portion between each press-contacting piece receiving groove 12*e* and each lead holding groove 12*d*, a bridge-like lead pressing portion 12*t* is provided to push each lead 22 into a press-contacting groove 14*c* of a press-contacting piece 14*b* which will be described later.

Figure 6:
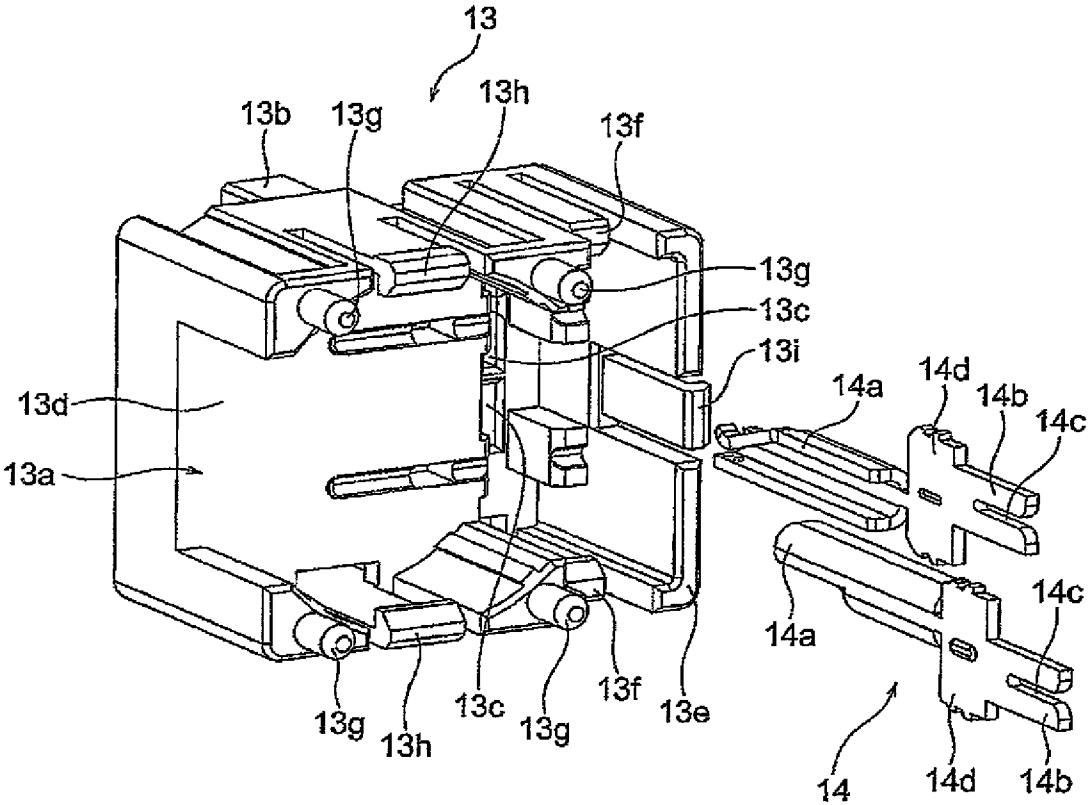
FIG. 6 is a perspective view of a second part 13 as seen from a coupling portion 13*a*.
Figure 7:
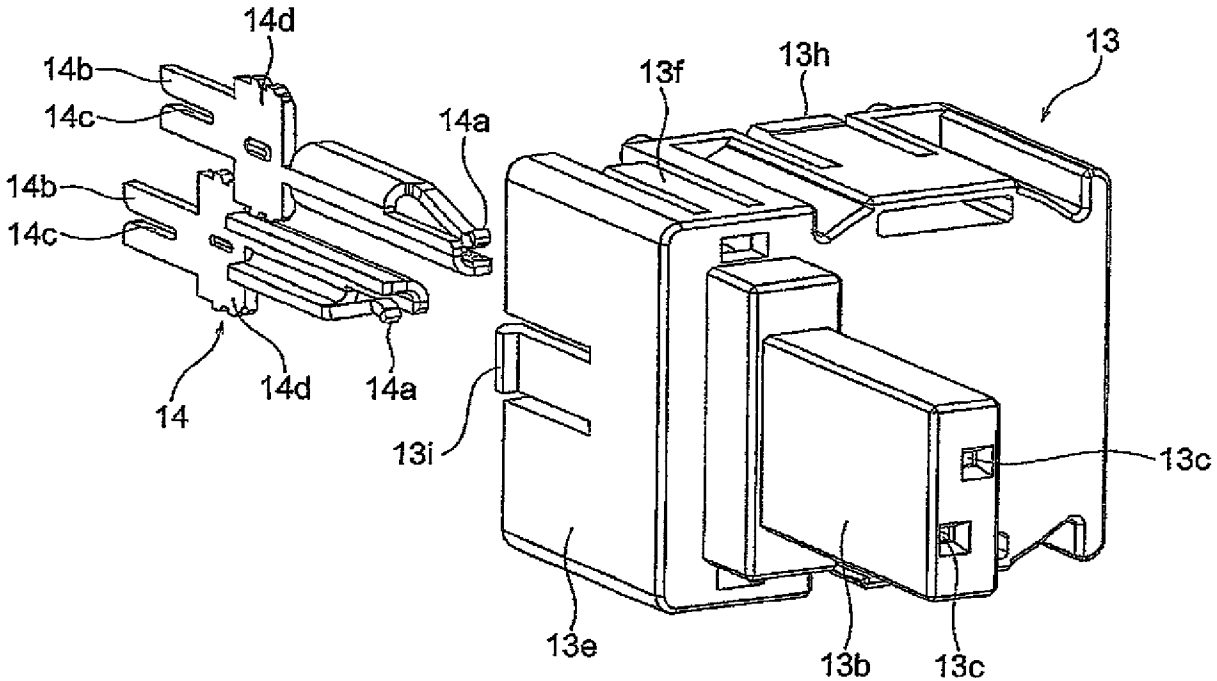
FIG. 7 is a perspective view of the second part 13 as seen from a fitting projecting portion 13*b*.

As illustrated in FIGS. 6 and 7, the second part 13 is a rectangular block member and comprises a recessed coupling portion 13*a* formed on its rear surface and adapted to be coupled to the first part 12, and a fitting projecting portion 13*b* formed on its front surface.

The coupling portion 13*a* comprises a peripheral wall portion 13*e* provided with first locking pieces 13*f*, second locking pieces 13*h*, and third locking pieces 13*i*. In addition, a pair of terminal receiving holes 13*c* are formed to penetrate from the coupling portion 13*a* to a forward end face of the fitting projecting portion 13*b*. The peripheral wall portion 13*e* comprises four positioning projections 13*g* formed at its rear end face.

Herein, the other surface 12*f* of the first part 12 and a bottom surface 13*d* (second surface) of the coupling portion 13*a* of the second part 13 are coupled to face each other and form closely-adjacent opposed surfaces.

As illustrated in FIGS. 6 and 7, each first terminal 14 comprises a socket-type first contacting portion 14*a* formed at its front end and comprising an elastic contact piece, the press-contacting piece 14*b* (lead connecting portion) formed at its rear end and comprising the press-contacting groove 14*c*, and a wide press-fitting portion 14*d* formed therebetween.

The first terminal 14 is held by the second part 13 by press-fitting the press-fitting portion 14*d* to a rear end of the terminal receiving hole 13*c* of the second part 13. The first contacting portion 14*a* is received in the terminal receiving hole 13*c* of the fitting projecting portion 13*b*. The press-contacting piece 14*b* projects rearward from the bottom surface 13*d* of the recessed coupling portion 13*a*.

The structure of the holder 10 has been described above.

Next, referring to FIGS. 4 and 5, and FIGS. 8 to 11, an assembling method of the holder 10 will be described.

First, as illustrated in FIG. 5, each lead 22 of the electrolytic capacitor 20 is perpendicularly bent at an intermediate position.

Figure 8:
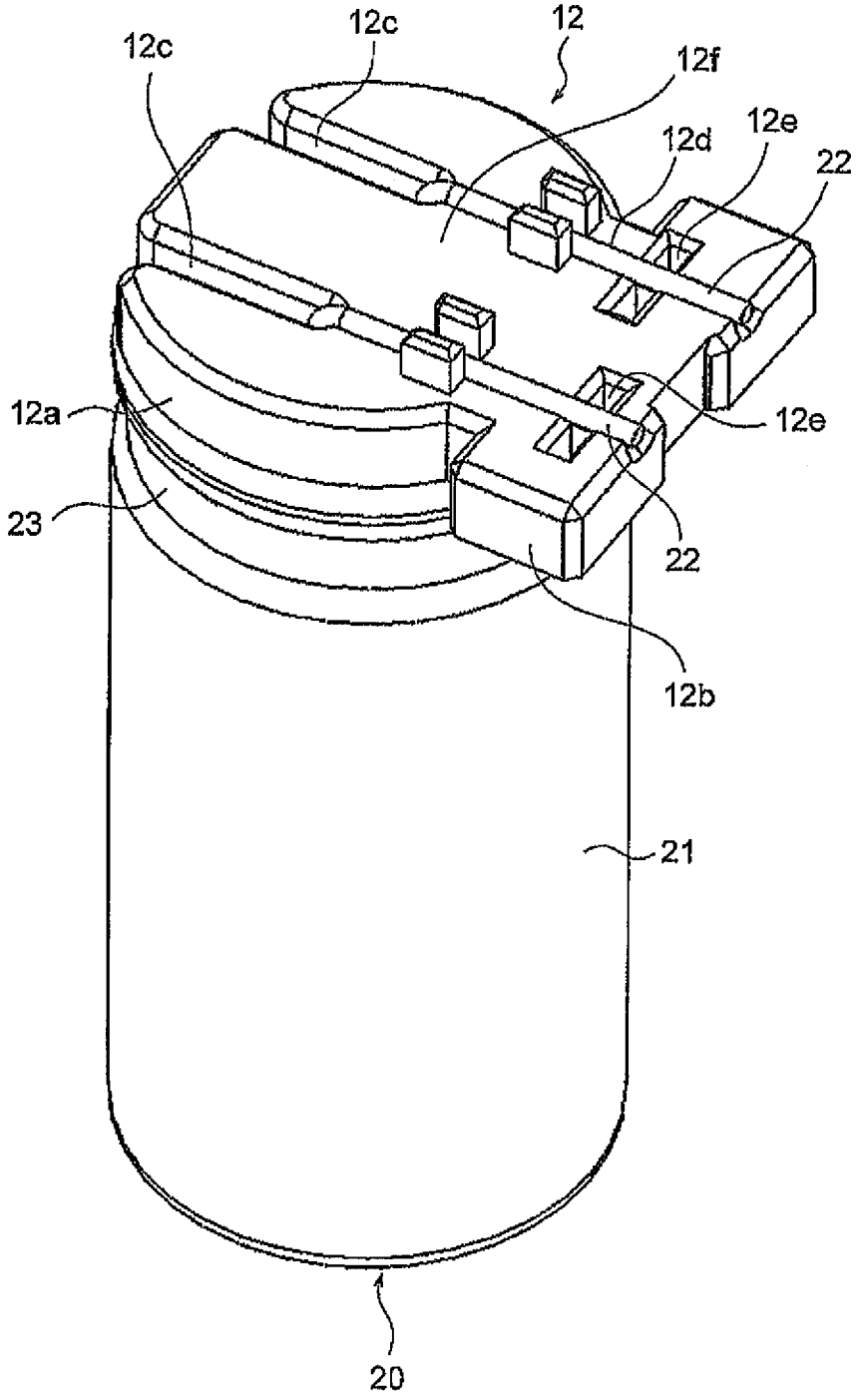
FIG. 8 is a perspective view showing the state where the electrolytic capacitor 20 is coupled to the first part 12.

Then, as illustrated in FIG. 8, the circular portion 12*a* of the first part 12 is attached to the end face of the electrolytic capacitor 20 on the side provided with the lead 22. The lead 22 is held by the lead holding groove 12*d* through the penetrating groove 12*c*.

Figure 9:
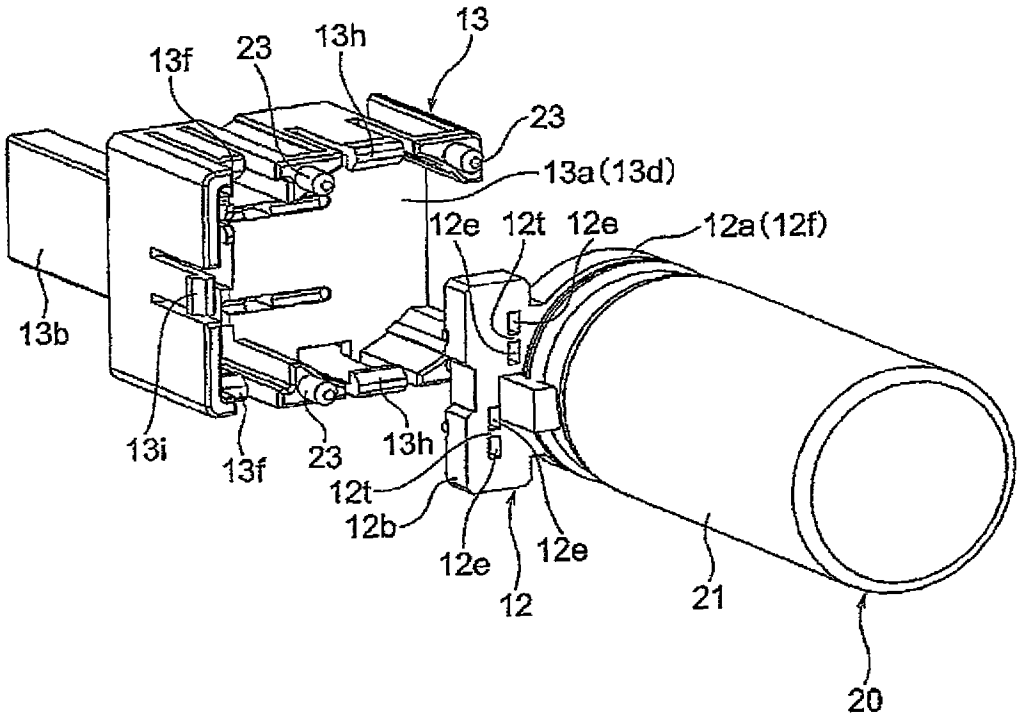
FIG. 9 is a perspective view showing a procedure of coupling the first part 12 to the second part 13.

As illustrated in FIG. 9, the other surface 12*f* of the first part 12 is faced to the bottom surface 13*d* of the coupling portion 13*a* of the second part 13. The first part 12 and the second part 13 are coupled to face each other in close proximity.

Figure 10:
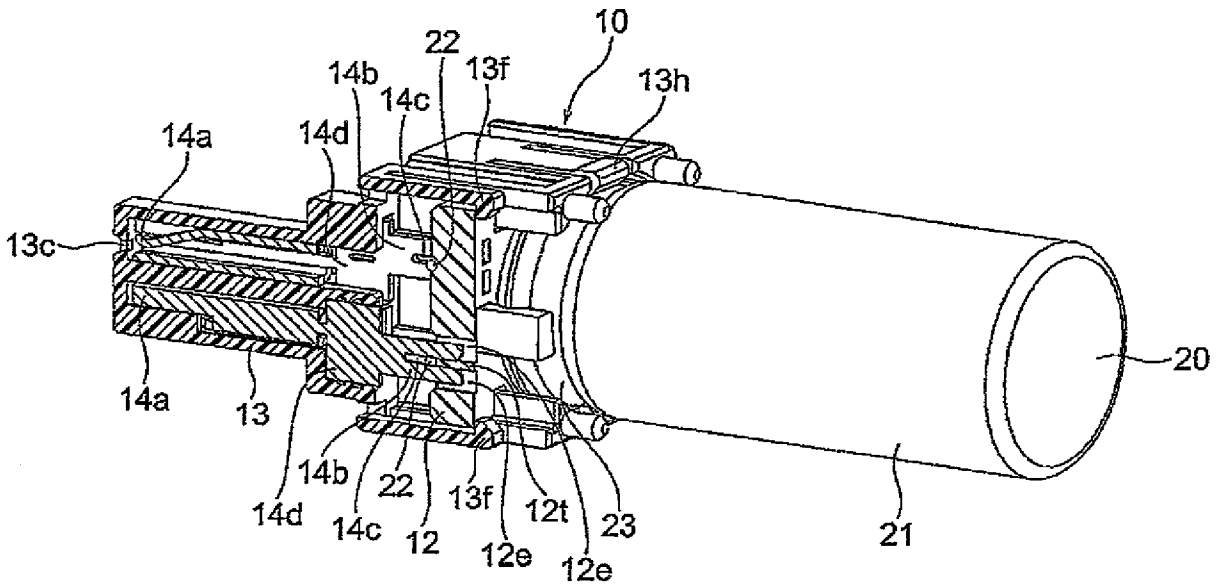
FIG. 10 is a perspective view (partially sectional view) showing the state where the electrolytic capacitor 20 is coupled to the holder 10.

In this event, as illustrated in FIG. 10, the press-contacting piece 14*b* of the second part 13 is inserted in the press-contacting piece receiving groove 12*e* of the first part 12. The lead 22 held by the lead holding groove 12*d* is pushed by the lead pressing portion 12*t* (see FIG. 5) into the press-contacting groove 14*c* and held thereby.

Simultaneously, the first locking piece 13*f* is engaged with a rear edge portion of the rectangular portion 12*b* so that the first part 12 is fixed to the second part 13 and the press-contacting connection state is maintained.

Figure 4:
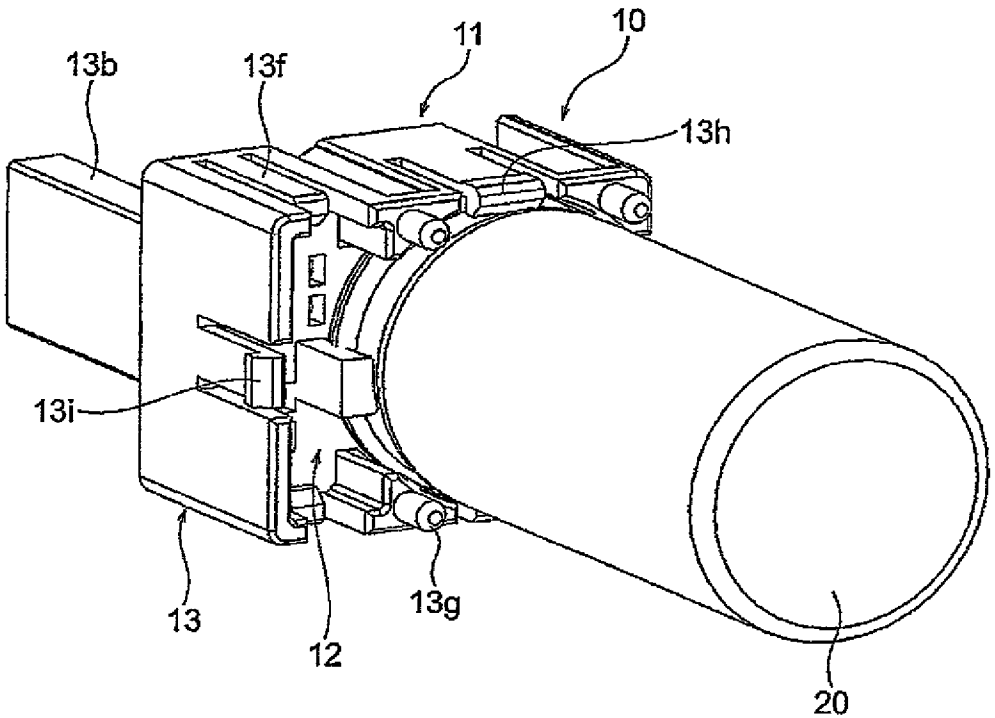
FIG. 4 is a perspective view showing the state where an electrolytic capacitor 20 is coupled to a holder 10.
Figure 11:
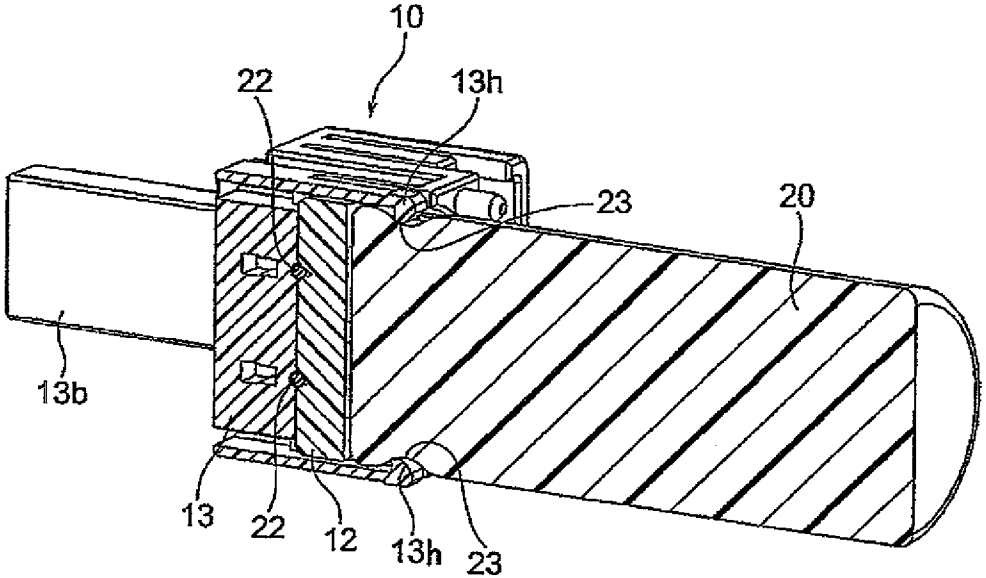
FIG. 11 is a perspective view (partially sectional view) showing the state where the electrolytic capacitor 20 is coupled to the holder 10.

As illustrated in FIG. 11, the second locking piece 13*h* is engaged with a constricted portion 23 formed on a peripheral surface of the body portion 21 of the electrolytic capacitor 20. Thus, as illustrated in FIG. 4, the first part 12 and the electrolytic capacitor 20 are integrally fixed to the second part 13.

The assembling method of the holder 10 has been described above.

Next, referring to FIGS. 1, 2, and 12, a structure of the board connector 30 will be described.

Figure 12:
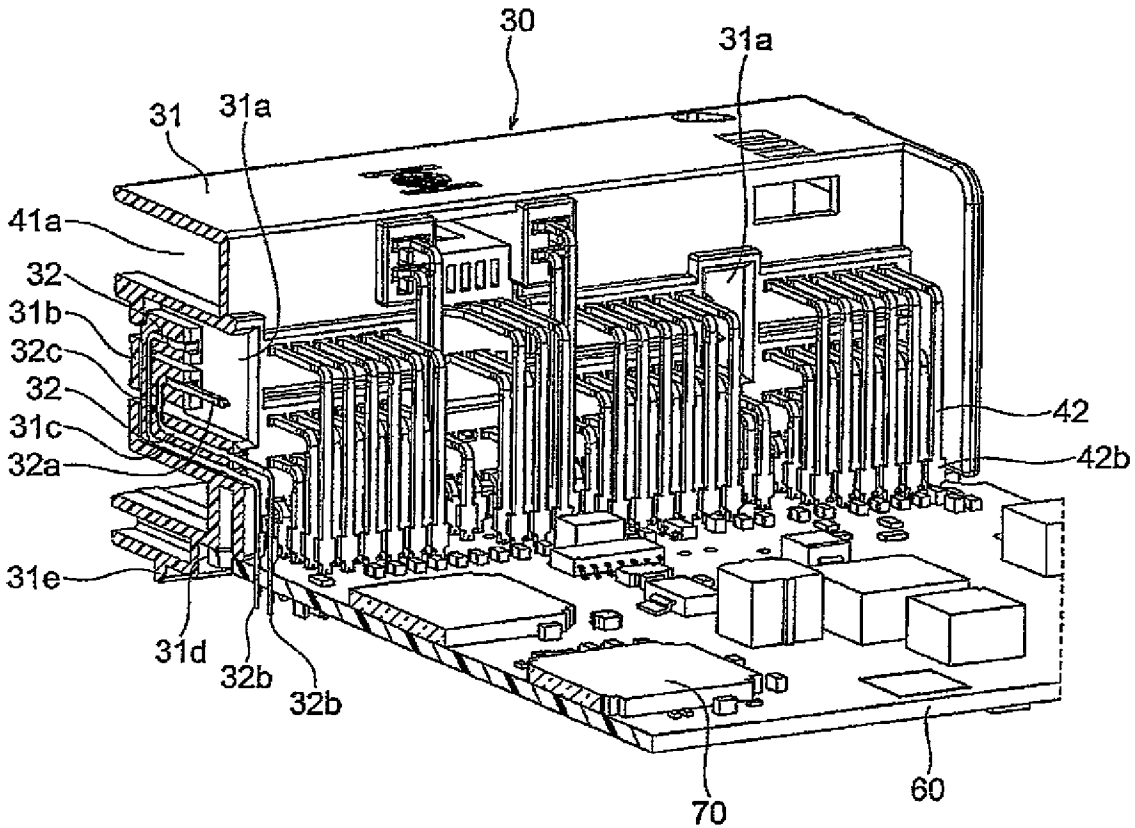
FIG. 12 is a perspective view (partially sectional view) of a board connector 30 and a board 60.

As illustrated in FIGS. 1, 2, and 12, the board connector 30 comprises an insulating housing 31 comprising holder fitting portions 31*a* (holder fitting holes) for fitting and attaching the holders 10 thereto, and second terminals 32 held by the housing 31.

In the first embodiment, the board connector 30 is integrally formed with an input/output connector 41. Accordingly, the housing 31 comprises, in addition to the holder fitting portions 31*a*, an input/output connector fitting hole 41*a* for inserting an input/output mating connector (not shown in the figure).

In the first embodiment, the input/output connector fitting hole 41*a* and the holder fitting portions 31*a* are opened at a front side of the housing 31 and at a rear side of the housing 31, respectively.

The input/output connector fitting hole 41*a* is widely opened at the front side of the housing 31. Each holder fitting portion 31*a* is formed by boring a hole, from the rear surface of the housing 31, in a block member 31*b* protruding from a bottom portion of the input/output connector fitting hole 41*a* into the input/output connector fitting hole 41*a*, thereby forming the hole-like holder fitting portion 31*a*. In FIGS. 1, 2, and 12, the holder fitting portion 31*a* is provided on each of left and right sides of the housing 31.

Each second terminal 32 is arranged in the holder fitting portion 31*a*. The second terminal 32 comprises one end provided with a pin-like second contacting portion 32*a*, the other end provided with a board connection portion 32*b*, and an intermediate portion provided with a U-shaped bending portion 32*c*. The second terminal is held by the housing 31 by press-fitting the bending portion 32*c* into a terminal protecting groove 31*c* of a L shape formed by cutting the holder fitting portion 31*a* from its bottom surface to its lower side surface.

The second contacting portion 32*a* protrudes from the bottom portion of the holder fitting portion 31*a* into the holder fitting portion 31*a*. The second terminal 32 is perpendicularly bent downward at one end of the U-shaped bending portion 32*c* led out on the rear surface of the housing 31 to form the board connecting portion 32*b* at its end.

The input/output connector 41 is formed by making a pin-like input/output terminal 42 penetrate the bottom portion of the input/output connector fitting hole 41*a* to be held thereby. The input/output terminal 42 comprises one end protruding from the bottom portion of the input/output connector fitting hole 41*a* into the input/output connector fitting hole 41*a* to form a contacting portion 42*a* to be brought into contact with a mating connector (not shown), and the other end led out from the rear surface of the housing 31 and then perpendicularly bent downward to form a board connecting portion 42*b* at its end.

Next, referring to FIGS. 13 and 14, a method of fitting the holder 10 to the board connector 30 will be described.

Figure 13:
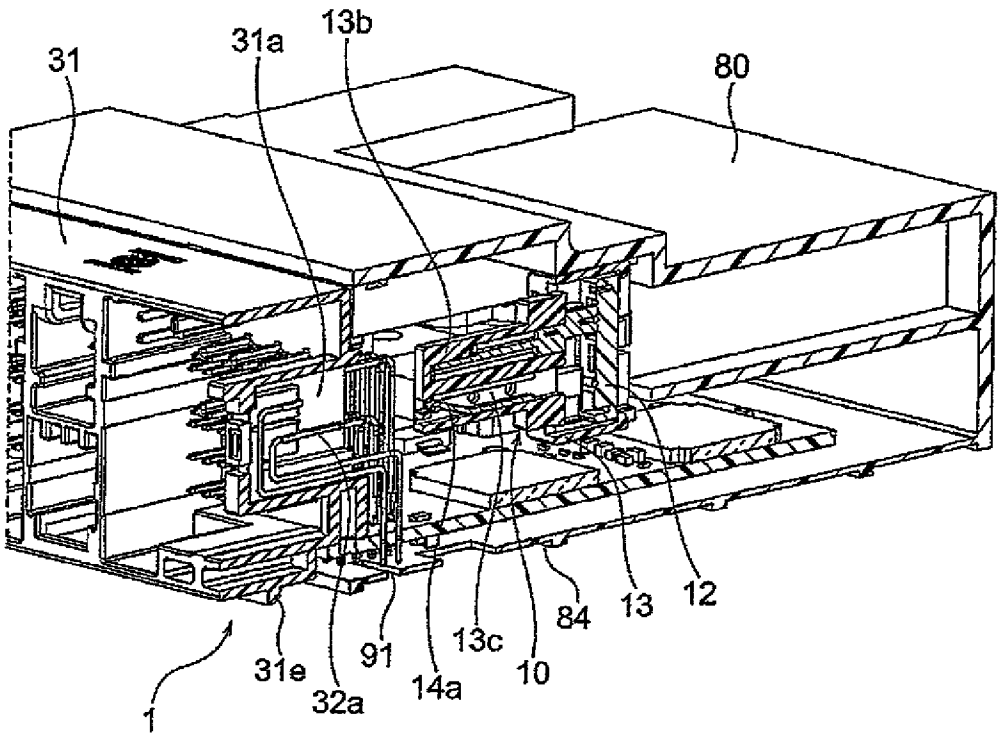
FIG. 13 is a perspective view (partially sectional view) showing a procedure of coupling the holder 10 to the board connector 30, where the electrolytic capacitor 20 is omitted from illustration.

At first, as illustrated in FIG. 13, the fitting projecting portion 13*b* of the holder 10 is faced to the holder fitting portion 31*a* and fitted thereto. Then, as illustrated in FIG. 13, the second contacting portion 32*a* in the holder fitting portion 31*a* is faced to the terminal receiving hole 13*c* opened at the end of the fitting projecting portion 13*b*.

Figure 14:
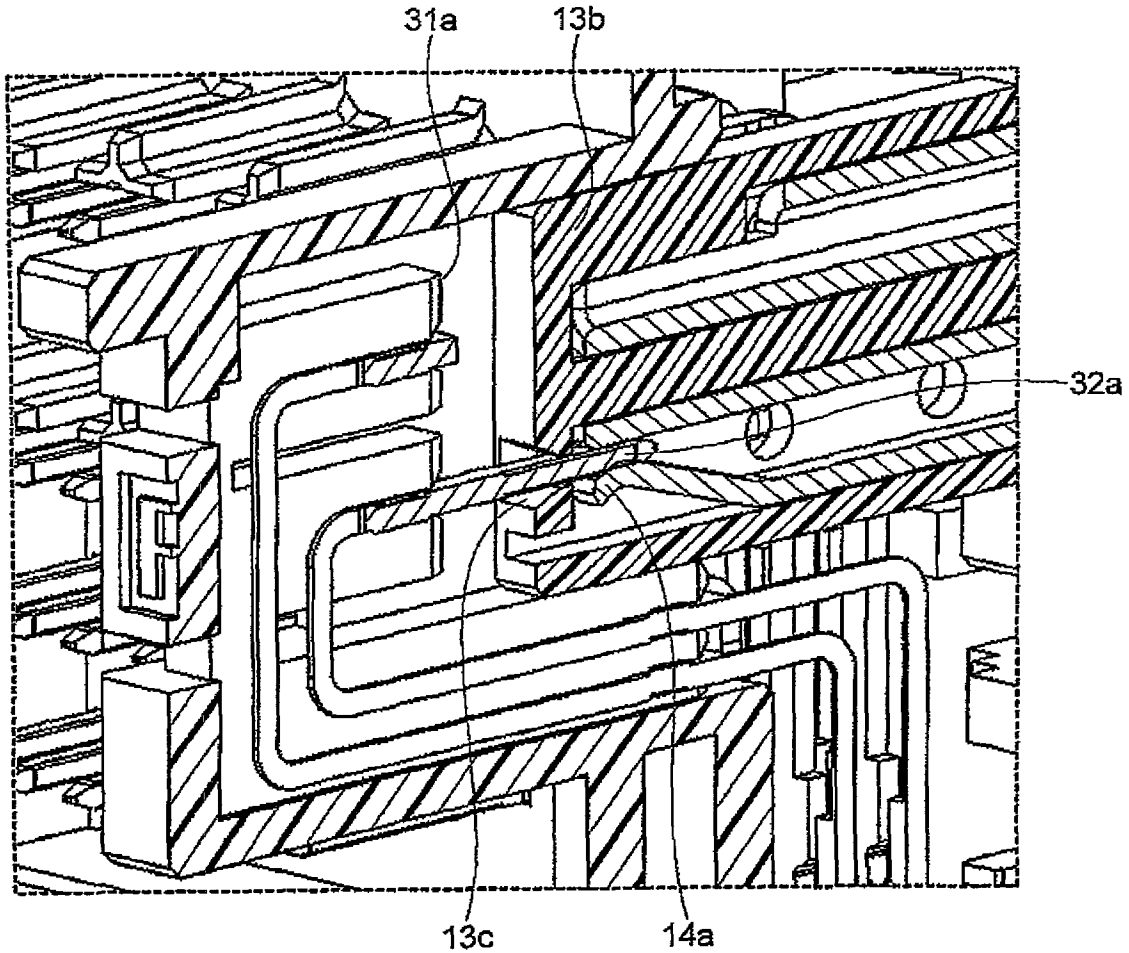
FIG. 14 is a sectional view showing a procedure of coupling the holder 10 to the board connector 30, where a part in vicinity of the fitting projecting portion 13*b* and a holder fitting portion 31*a* are enlarged.

As illustrated in FIG. 14, fitting operation is further continued until the end of the fitting projecting portion 13*b* is brought into contact with the bottom portion of the holder fitting portion 31*a*. Then, the holder 10 is fitted to and held by the board connector 30 and the second contacting portion 32*a* is inserted into the terminal receiving hole 13*c* and brought into contact with the first contacting portion 14*a*. The lead 22 of the electrolytic capacitor 20 is electrically connected, via the first terminal 14 and the second terminal 32, to a circuit pattern which is not shown in the figure and which is formed on the board 60 with the board connector 30 connected thereto.

Next, referring to FIGS. 1, 2, 12, and 15, description will be made about structures of parts of the electronic circuit apparatus 5 except the board mount connector 1.

At first, a structure of the case 80 will be described.

Figure 15:
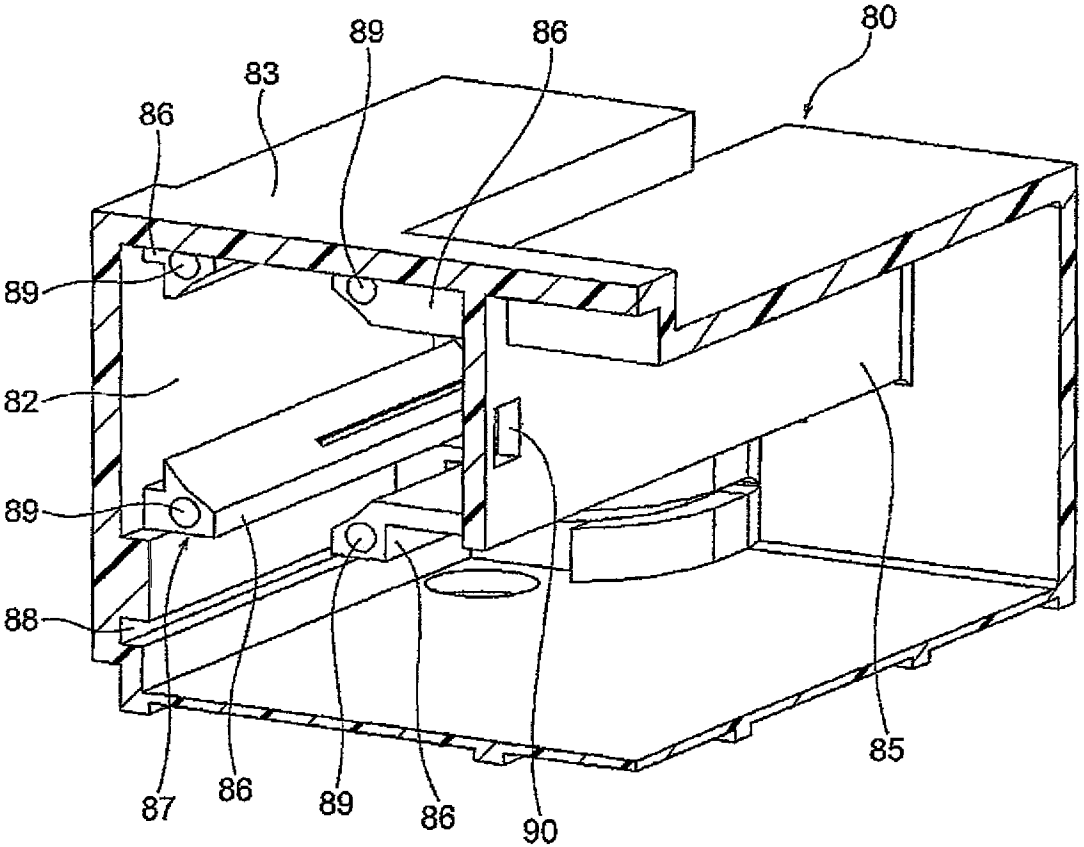
FIG. 15 is an enlarged perspective view (partially sectional view) of a case 80 in the vicinity of a holder holding portion 87.

As illustrated in FIGS. 1, 2, and 15, the case 80 has a box shape with an opening portion 81 formed at its front side. As illustrated in FIG. 15, the case 80 comprises, in an upper part of a rear inner portion of the case 80, four rib protrusions 86 respectively formed on a side wall 82 and an upper wall 83 of the case 80 and on a vertical wall 85 vertically extending downward from the upper wall 83. A holder holding portion 87 for holding the holder 10 is formed by the four rib protrusions 86. The four rib protrusions 86 comprise four positioning holes 89 formed at front end faces thereof, respectively.

In the first embodiment, the holder holding portion 87 is provided on each of left and right sides in the case 80 in correspondence to the holder fitting portion 31*a* of the board connector 30.

The left and the right side walls 82 in the opening portion 81 are provided with board holding grooves 88 to be engaged with left and right side edges of the board 60 so that the board 60 is inserted and guided from the opening portion 81 to a predetermined position inside the case 80

The opening portion 81 has a size such that a peripheral outer shape of the board connector 30 is just fitted thereinto.

Next, a structure of the board 60 will be described.

As illustrated in FIGS. 2 and 12, the board 60 is a printed wiring board comprising circuit patterns formed on both upper and lower surfaces thereof. On the board 60, other circuit elements 70 except the electrolytic capacitor 20 are mounted. At a front edge portion, the board connector 30 is mounted so that the input/output connector fitting hole 41*a* is faced frontward and the holder fitting portion 31*a* is faced rearward (towards the board).

More specifically, the edge portion of the board 60 is brought into contact with a board edge mounting portion 31*d* formed on a lower surface of the board connector 30. The board connecting portion 42*b* of the input/output terminal 42 and the board connecting portion 32*b* of the second terminal 32 are inserted into through holes, not shown in the figure, of the board 60 and soldered to the circuit patterns not shown in the figure so that the board connector 30 is mounted to the board 60.

Next, referring to FIGS. 1 to 15, description will be made about a procedure of mounting the electrolytic capacitor 20 to the board 60 (electronic circuit apparatus 5).

At first, the electrolytic capacitor 20 is attached to the holder 10 as described above (see FIGS. 4 to 11).

Next, as illustrated in FIGS. 2 and 3, the electrolytic capacitor 20 is attached (lightly press-fitted) to the holder holding portion 87 of the case 80. Specifically, the body portion 21 of the electrolytic capacitor 20 is inserted among the four rib protrusions 86 and the rear side surface of the peripheral wall portion 13*e* (see FIG. 7) of the second part 13 is abutted to the front side surfaces of the rib protrusions 86.

Then, the body portion 21 is supported by the four rib protrusions 86. Simultaneously, the four positioning projections 13*g* (see FIG. 6) formed on the rear end face of the peripheral wall portion 13*e* of the second part 13 are inserted in the four positioning holes 89 formed on the front end faces of the rib protrusions 86 to be positioned. The third locking piece 13*i* formed on the peripheral wall portion 13*e* of the second part 13 is engaged with a locking hole 90 formed on the vertical wall 85 of the holder holding portion 87. Thus, as illustrated in FIG. 2, the holder 10 and the electrolytic capacitor 20 are attached and fixed to the case 80.

Next, as illustrated in FIG. 2, the board 60 with the board connector 30 mounted to its edge portion is pushed into the opening portion 81 of the case 80 in the state where the left and the right side edges thereof are engaged with the board holding grooves 88, so that the board connector 30 is fitted to the opening portion 81. Then, the fitting projecting portion 13*b* of the holder 10 held by the case 80 is fitted to the holder fitting portion 31*a* of the board connector 30. The first contacting portion 14*a* of the holder 10 is brought into contact with the second contacting portion 32*a* of the board connector 30. The lead 22 of the electrolytic capacitor 20 is electrically connected through the first terminal 14 and the second terminal 32 to the circuit pattern, not shown in the figure, of the board 60.

Simultaneously, a locking projection 31*e* (see FIG. 13) formed on a lower surface of the housing 31 of the board connector 30 is engaged with a locking hole 91 formed on a lower wall 84 of the case 80 so that the holder 10, the board 60, and the board connecter 30 are fixedly held by the case 80.

By the procedure described above, the electrolytic capacitor 20 is mounted to the board 60.

In this state, the electrolytic capacitor 20 is mounted transversely in a floating state above the circuit elements 70 of the board 60.

As described above, in the first embodiment, the electrolytic capacitor 20 can be mounted on the board 60 by making the holder 10 hold the electrolytic capacitor 20 and by fitting and connecting the holder to the board connector 30 connected to the board 60. Accordingly, in the event of, for example, replacement of the electrolytic capacitor 20 upon occurrence of failure, desoldering operation or the like is not required at the board connecting portion and reworking is easier than before.

The electrolytic capacitor 20 and the lead 22 are held by the holder 10 and the holder 10 is held by the holder fitting portion 31*a* of the board connector 30. Accordingly, stress concentration to the lead 22 due to the vibration or the like does not occur. Therefore, it is possible to achieve stable mounting and connection of the electrolytic capacitor 20 to the board 60.

Since the electrolytic capacitor 20 is mounted in a floating state above the circuit elements 70 of the board 60, the mounting efficiency of the circuit elements 70 with respect to the board 60 can be improved as compared with the case where the electrolytic capacitor 20 is directly mounted.

Thus, in the electronic circuit apparatus 5 according to the first embodiment, the mounting efficiency and the connection stability of the electrolytic capacitor 20 are compatible.

Furthermore, by integrally forming the board connector 30 and the input/output connector 41, it is possible to reduce the number of components of the electronic circuit apparatus 5, to achieve reduction in size of the apparatus, and to improve the connector mounting workability.

Next, referring to FIGS. 16 to 28, description will be made about a structure of a board mount connector 1' according to a second embodiment.

The board mount connector 1' according to the second embodiment is similar in structure to the first embodiment. However, in the first embodiment, the holder 10 is fitted and attached to the board connector 30 from its rear side while, in the second embodiment, a holder 10' is fitted and attached to a board connector 30' from its front side.

At first, referring to FIGS. 16 and 17, description will be made about a structure of an electronic circuit apparatus 5' mounted with the board mount connector 1', according to the second embodiment of the present invention, for mounting an electrolytic capacitor to a board.

Figure 16:
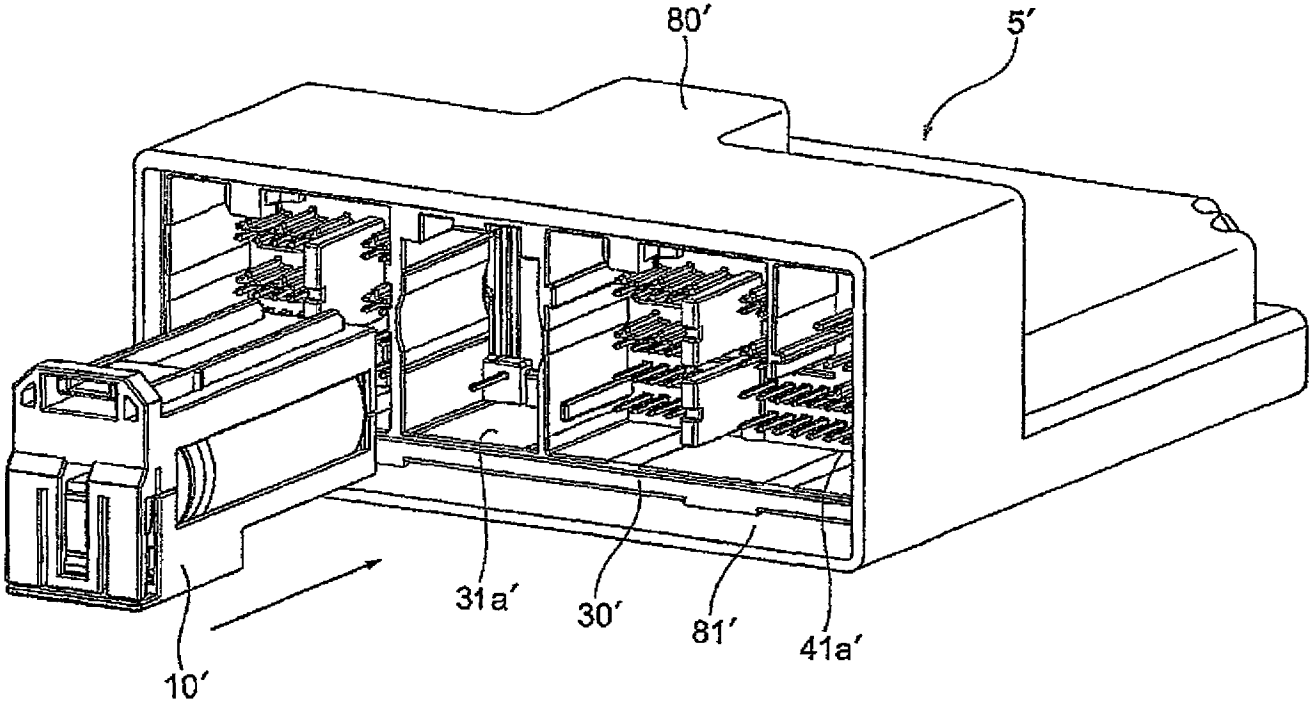
FIG. 16 is an exploded perspective view of an electronic circuit apparatus 5'.
Figure 17:
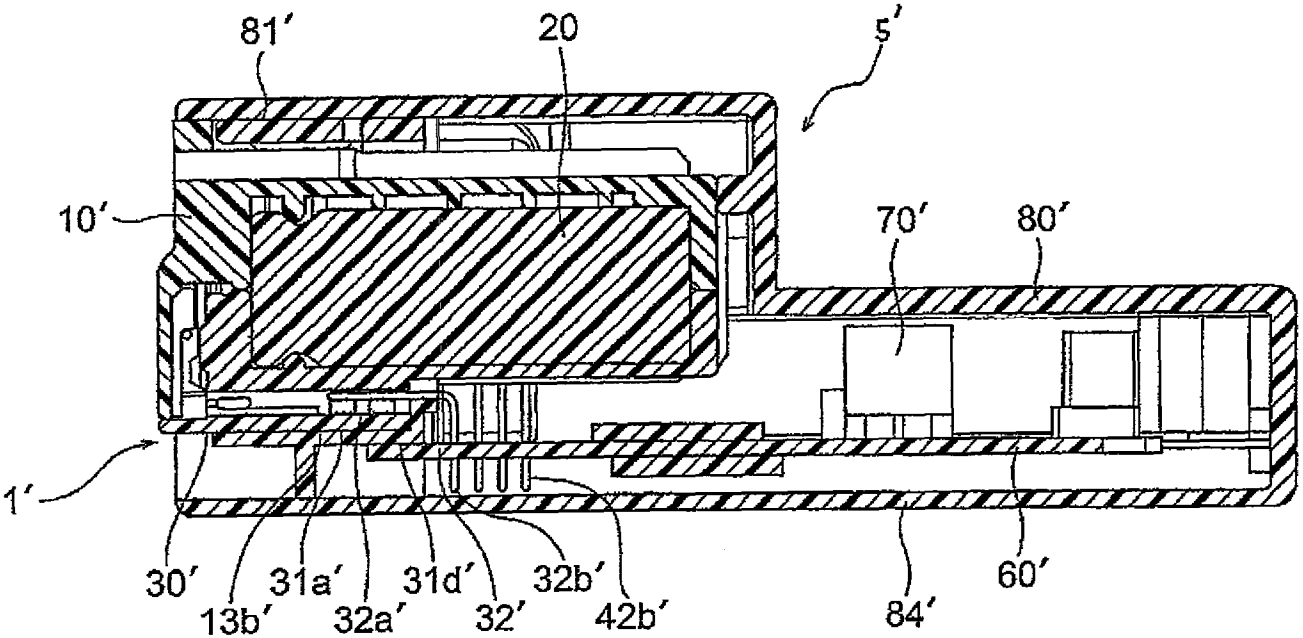
FIG. 17 is a sectional view of the electronic circuit apparatus 5'.

As illustrated in FIGS. 16 and 17, the electronic circuit apparatus 5' comprises a board 60' with circuit elements 70' mounted thereto, a case 80' holding and surrounding the board 60', and the board mount connector 1' mounted to the board 60' and holding electrolytic capacitors 20.

The board mount connector 1' comprises a board connector 30' to be mounted to the board 60' and holders 10' as insulating holding members connected to the board connector 30' and adapted to hold the electrolytic capacitors 20. By mounting the board connector 30' to the board 60', the electrolytic capacitor 20 is mounted to the board 60' via the board mount connector 1'.

Next, referring to FIGS. 18 to 28, description will be made in detail about structures of the electronic circuit apparatus 5' and the board mount connector 1'.

Next, referring to FIGS. 18 and 19, the structure of the board mount connector 1' will be described.

Figure 18:
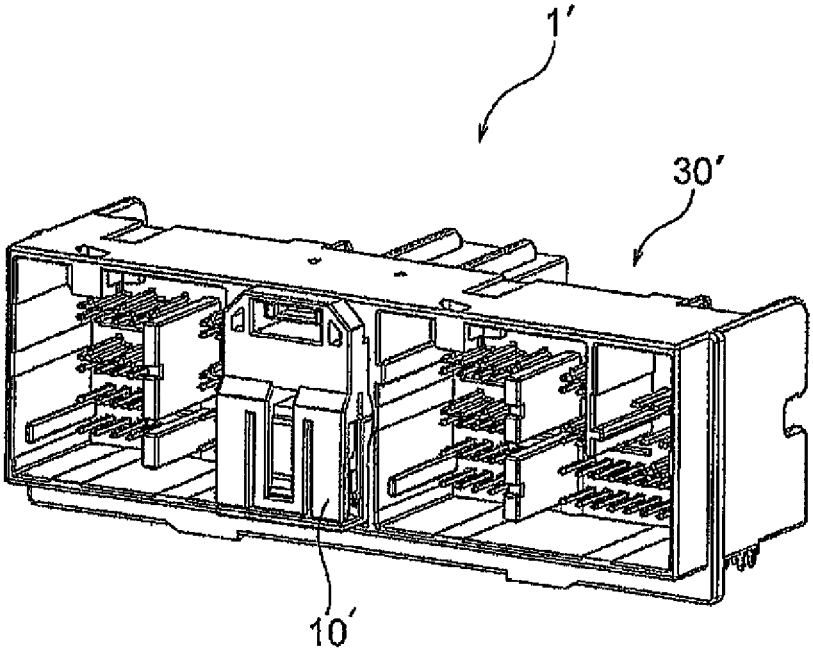
FIG. 18 is a perspective view showing the state where a holder 10' is coupled to a board connector 30'.
Figure 19:
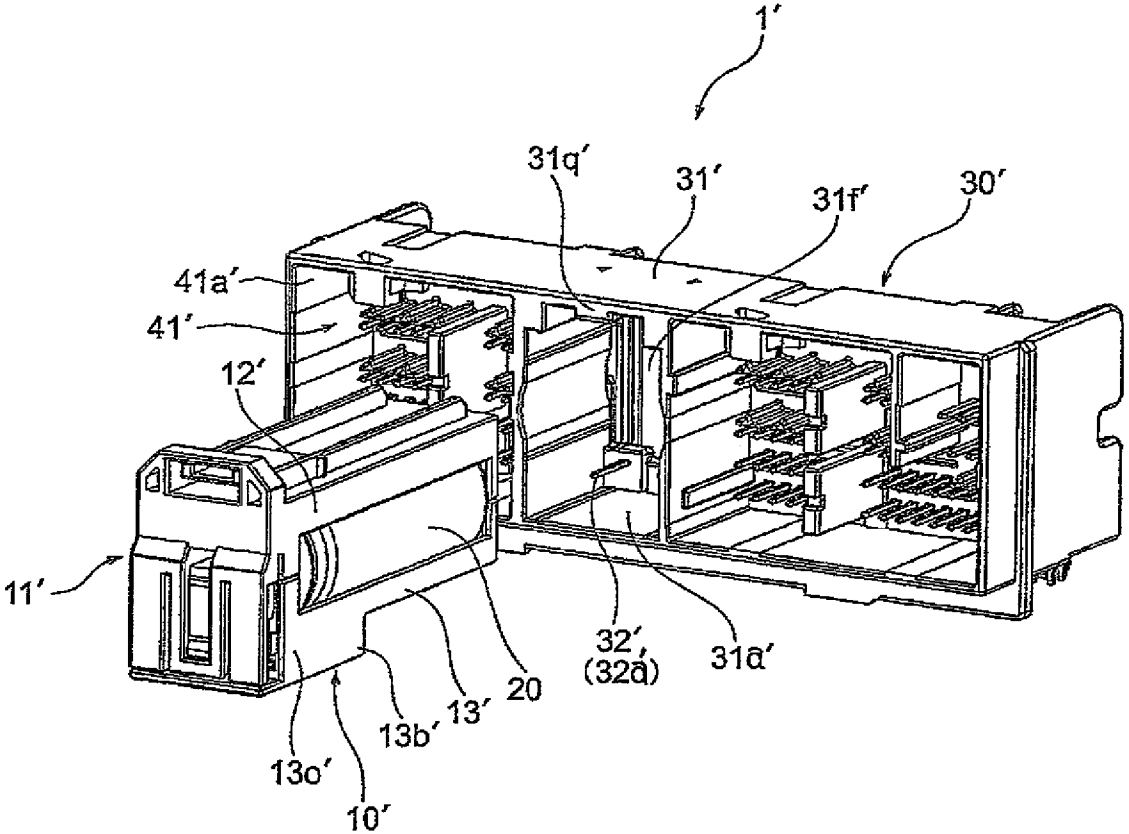
FIG. 19 is an exploded perspective view of FIG. 18.

As illustrated in FIGS. 18 and 19, the board mount connector 1' comprises a board connector 30' to be mounted to the board 60' and holders 10' as insulating holding members connected to the board connector 30' and adapted to hold the electrolytic capacitors 20. By mounting the board connector 30' to the board 60', the electrolytic capacitor 20 is mounted to the board 60' via the board mount connector 1'.

Next, referring to FIGS. 19 to 27, description will be made in detail about a structure of the board mount connector 1'.

At first, referring to FIGS. 19 to 27, the structure of the holder 10' of the board mount connector 1' will be described in detail.

As illustrated in FIGS. 19 to 27, the holder 10' comprises an insulating holding member 11' holding the electrolytic capacitor 20 and first terminals 14' held by the holding member 11'.

The holding member 11' comprises a first part 12' (upper holder) and a second part 13' (lower holder) adapted so that the electrolytic capacitor 20 is vertically clamped therebetween and coupled thereto.

The first part 12' and the second part 13' have a U shape, are faced to each other in a vertical direction, and comprise a first holding portion 12*g'* and a second holding portion 13*j'*, respectively, which extend in a longitudinal direction (back-and-forth direction) of the body portion 21 of the electrolytic capacitor 20 to clamp and hold the body portion 21 therebetween.

Furthermore, the first part 12' and the second part 13' comprise a first wall portion 12*h'* and a second wall portion 13*k'*, respectively, which protrude towards each other (downward and upward) from longitudinal one ends (front ends) of the first holding portion 12*g'* and the second holding portion 13*j'* to be abutted to each other. In addition, the first part and the second part comprise a third wall portion 12*i'* and a fourth wall portion 13*l'*, respectively, which protrude towards each other from the other ends (rear ends) to be abutted to each other.

Herein, the first wall portion 12*h'* of the first part 12' and the second wall portion 13*k'* of the second part 13' have a lower end face 12*f'* (see FIG. 23) and an upper end face 13*d'* (see FIG. 24), respectively, which form opposite surfaces to be faced to each other in close proximity when these parts are coupled to each other.

The first holding portion 12*g'* and the second holding portion 13*j'* comprise inner surfaces (upper and lower opposite surfaces) provided with arcuately-recessed body holding portions 12*j'* (see FIG. 23) and 13*m'* (see FIG. 21) adapted to hold the body portion 21 of the electrolytic capacitor 20.

Figure 23:
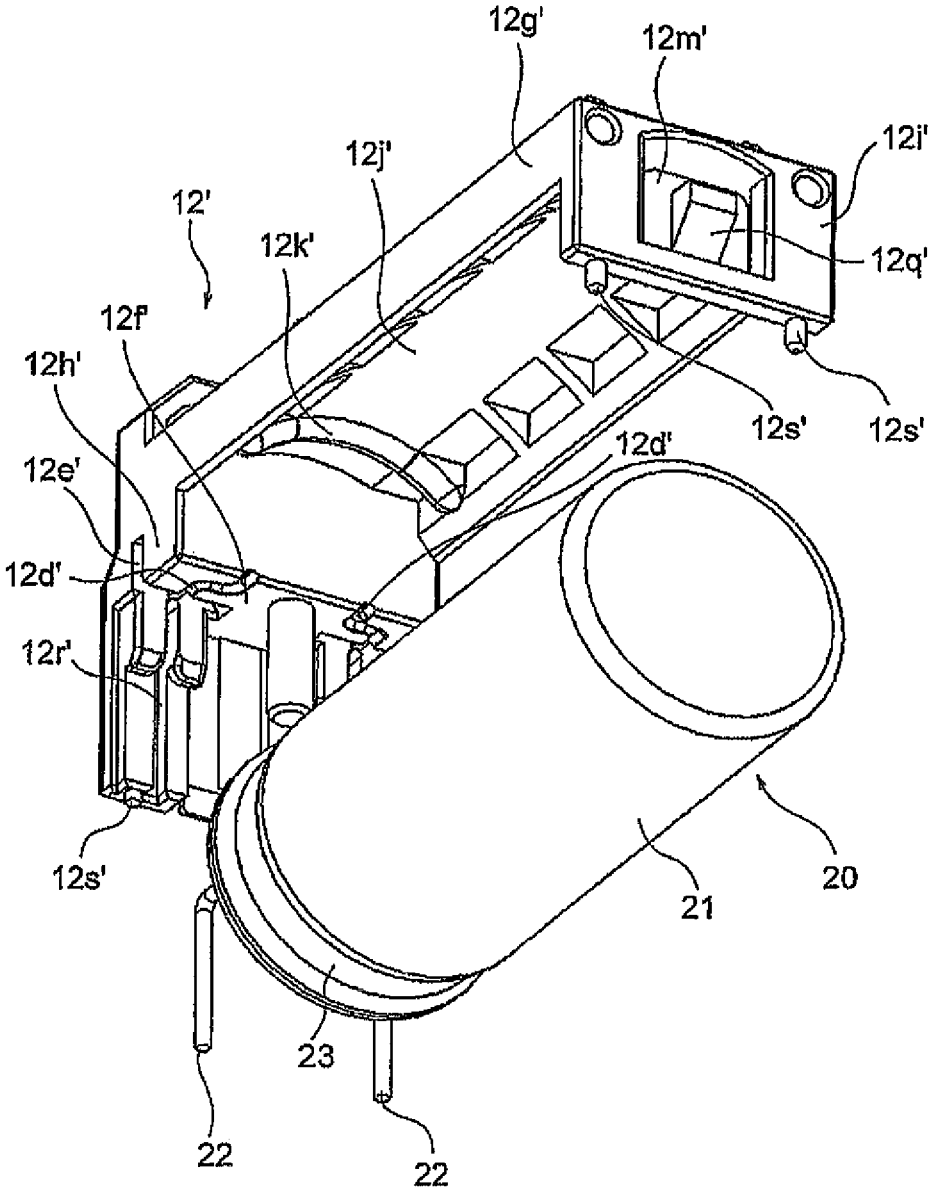
FIG. 23 is a perspective view showing the first part 12' and the electrolytic capacitor 20.
Figure 24:
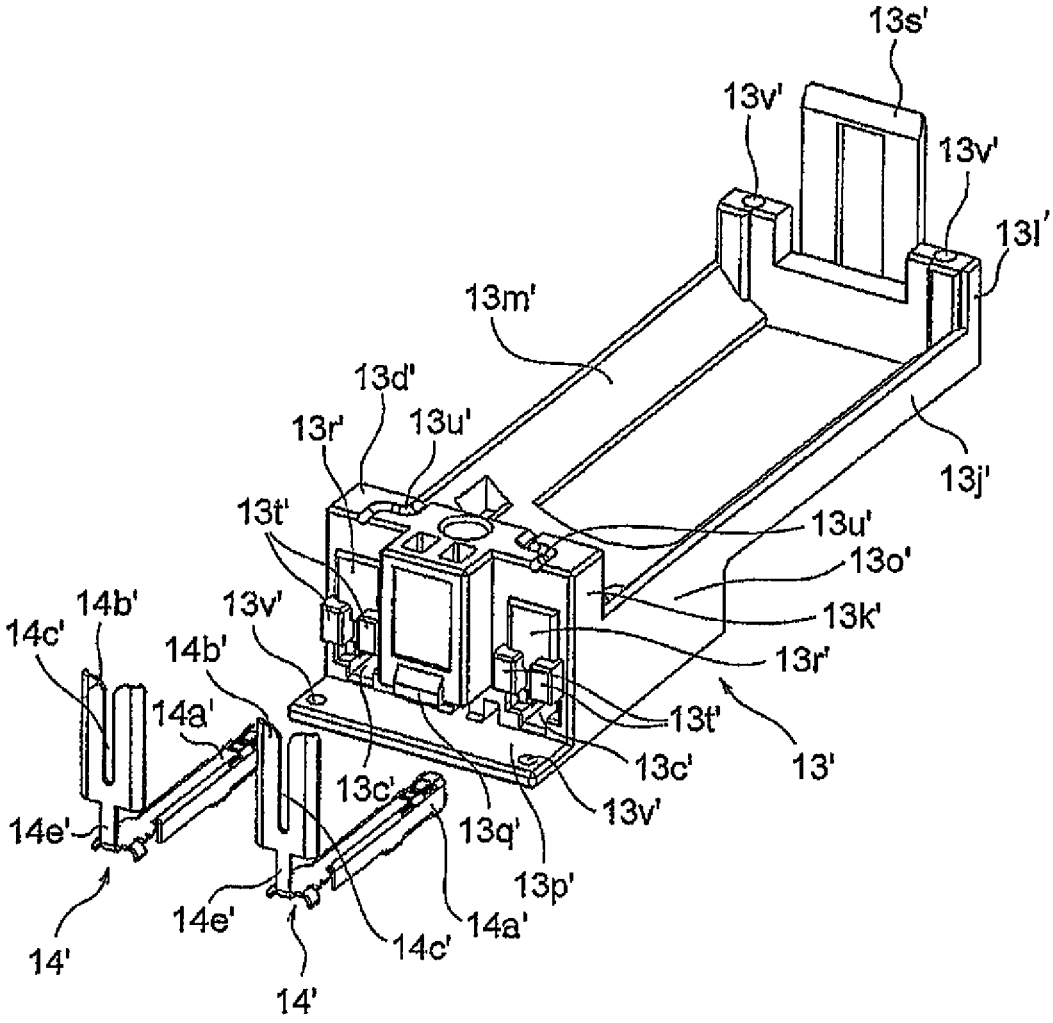
FIG. 24 is a perspective view showing a second part 13' and first terminals 14'.
Figure 25:
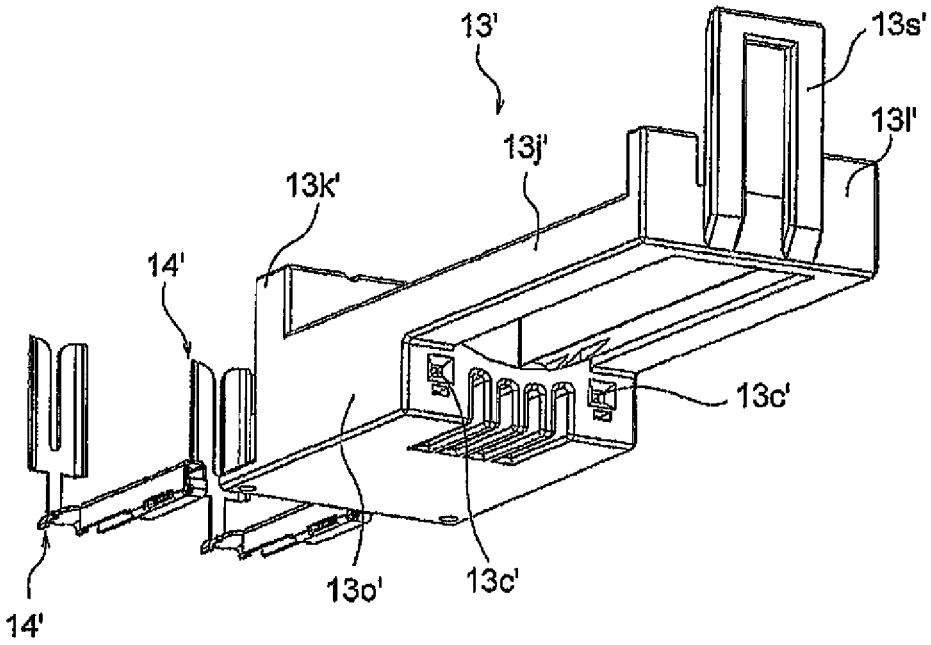
FIG. 25 is a perspective view showing the second part 13' and first terminals 14'.
Figure 27:
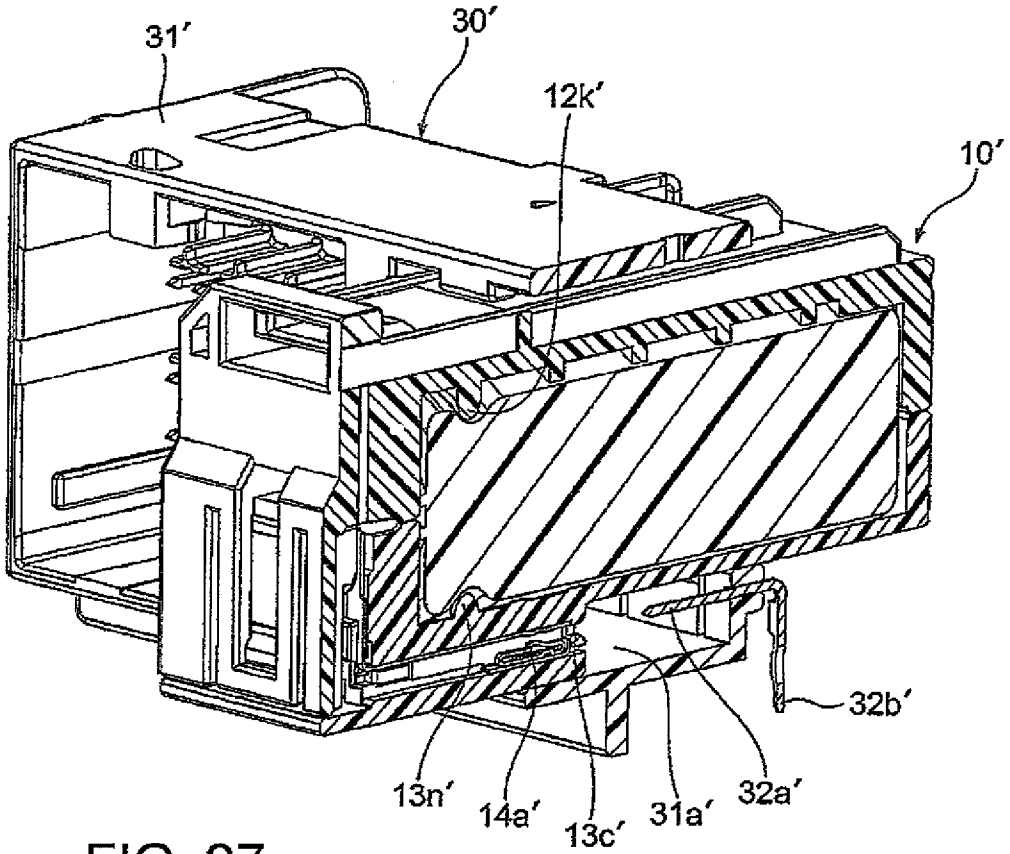
FIG. 27 is a perspective view (partially sectional view) showing a procedure of coupling the holder 10' to the board connector 30' in the state where the electrolytic capacitor 20 is coupled to the holder 10'.

The body holding portions 12*j'* and 13*m'* comprise rib protrusions 12*k'* and 13*n'*, respectively, to be engaged with the constricted portion 23 formed on the peripheral surface of the body portion 21 of the electrolytic capacitor 20 (see FIGS. 23, 24, and 27). The lower end face 12*f'* of the first wall portion 12*h'* and the upper end face 13*d'* of the second wall portion 13*k'* are provided with crank-shaped lead holding grooves 12*d'* and 13*u'*, respectively, to receive, clamp, and hold the lead 22 of the electrolytic capacitor 20.

The lower end face 12*f'* of the first wall portion 12*h'* comprises press-contacting piece receiving grooves 12*e'* which penetrate therethrough and intersect with the lead holding grooves 12*d'*. At an intersecting portion between each press-contacting piece receiving groove 12*e'* and each lead holding groove 12*d'*, a bridge-like lead pressing portion 12*t'* is provided to push each lead 22 into a press-contacting groove 14*c'* of a press-contacting piece 14*b'* which will be described later (see FIG. 26).

The first part 12' comprises a fifth wall portion 12*l'* projecting downward from an outer surface (front surface) of the first wall portion 12*h'*, a cantilevered pressing spring piece 12*m'* formed by making a U-shaped cut groove in the third wall portion 12*i'*, and a cantilevered locking piece 12*n'* standing upward from an upper surface of the first holding portion 12*g'* and extending forward. The fifth wall portion 12*l'* is provided with a U-shaped first engaging piece 12*o'* formed by making cut grooves in a vertical direction, and a lead holding groove extending portion 12*r'* which is formed on an inner surface thereof and which is connected to the lead holding groove 12*d'* and extends downward.

The pressing spring piece 12*m'* is a member (provisional holding means) for provisionally holding the body portion 21 of the electrolytic capacitor 20 by pressing forward a rear end surface of the body portion 21 to elastically clamp the body portion 21 between the first wall portion 12*h'* and the pressing spring piece 12*m'* in the state where the body portion 21 is attached to the first holding portion 12*g'*. The pressing spring piece 12*m'* has a plate thickness thinner than that of other parts of the third wall portion 12*i'* to ensure spring property. The pressing spring piece 12*m'* has an inner surface provided with a pressing projection 12*p'* adapted to press the rear end face of the body portion 21.

The pressing spring piece 12*m'* comprises an outer surface provided with a first engaging projecting portion 12*q'* to be engaged with a U-shaped second engaging piece 13*s'*, which will be described later, of the second part 13'.

The second part 13' comprises a protruding portion 130' protruding downward at a front end of the second holding portion 13*j'* and comprising a terminal receiving hole 13*c'* penetrating therethrough in a back-and-forth direction, a horizontal wall portion 13*p'* projecting forward from a lower end of the protruding portion 13*o'*, a second engaging projecting portion 13*q'* formed at the center of an outer surface (front surface) of the second wall portion 13*k*' to be engaged with the first engaging piece 12*o*', press-contacting piece attaching portions 13*r*' formed at right and left sides of the outer surface (front surface) of the second wall portion 13*k*' and having a one-step-high convex-shape, and the U-shaped second engaging piece 13*s*' protruding upward from an outer surface (rear surface) of the fourth wall portion 13*l*'.

A first terminal 14' comprises a socket-type first contacting portion 14*a*' formed at its one end and comprising an elastic contacting piece, a press-contacting piece 14*b*' formed at the other end and comprising a press-contacting groove 14*c*', and a narrow middle portion 14*e*' provided between the first contacting portion 14*a*' and the press-contacting piece 14*b*'. The first terminal is perpendicularly bent at a connecting portion of the middle portion 14*e*' and the first contacting portion 14*a*' and has an L shape as a whole.

The first terminal 14' is held by the second part 13' by inserting the first contacting portion 14*a*' from the front side into the terminal receiving hole 13*c*' to press-fit the middle portion 14*e*' between a pair of press-fitting projecting portions 13*t*' formed on the press-contacting piece attaching portion 13*r*'. The press-contacting piece 14*b*' is attached to the press-contacting piece attaching portion 13*r*' in the manner such that its end (upper side) protrudes upward from the upper end face 13*d*' of the second wall portion 13*k*' and a part of the press-contacting groove 14*c*' intersects with the lead holding groove 13*u*'.

Next, referring to FIGS. 20 to 26, an assembling method of the holder 10' will be described.

Figure 22:
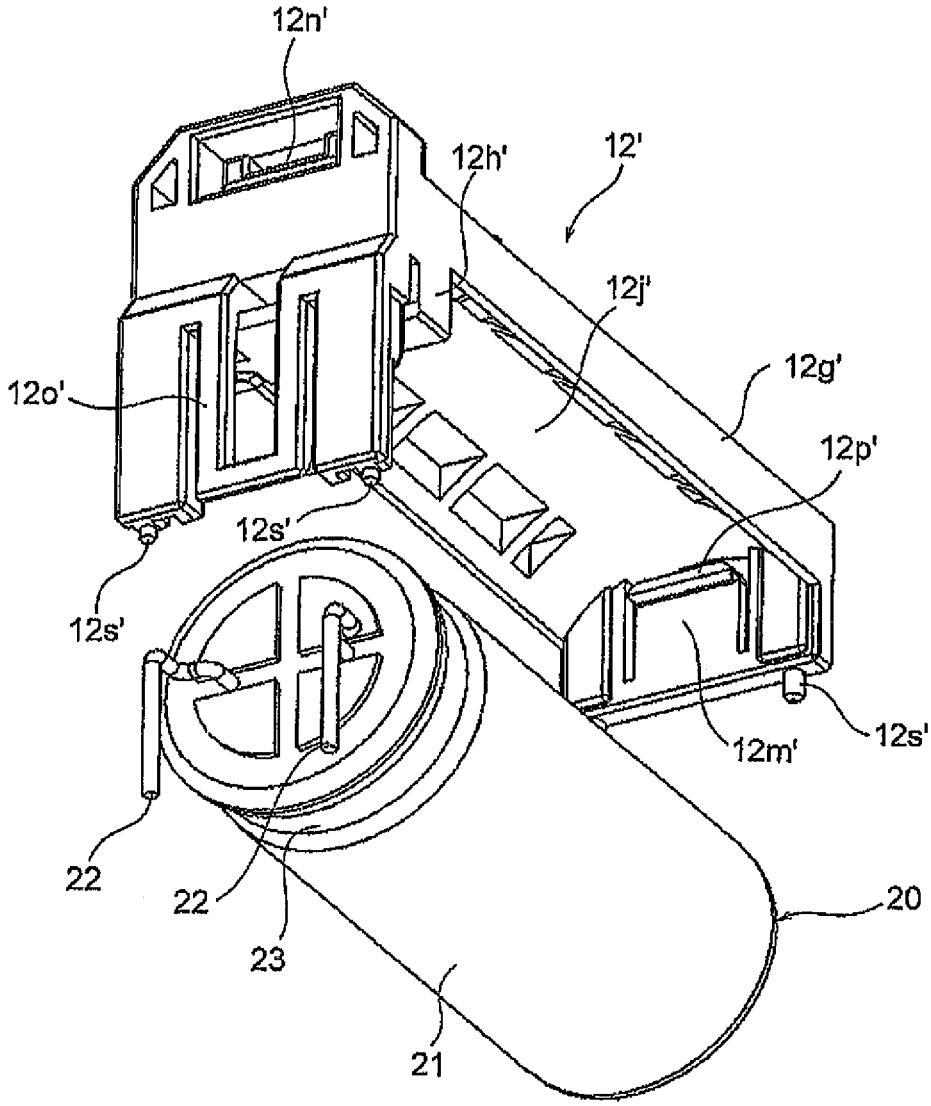
FIG. 22 is a perspective view showing the first part 12' and the electrolytic capacitor 20.

First, as illustrated in FIG. 22, the lead 22 of the electrolytic capacitor 20 is bent.

Specifically, a base portion of the lead 22 is bent in a crank shape in conformity with the shapes of the lead holding grooves 12*d*' and 13*u*'. A remaining extending portion thereof is perpendicularly bent downward to extend vertically downward.

Next, as illustrated in FIGS. 22 and 23, the electrolytic capacitor 20 is positioned below the first part 12'. The body portion 21 is attached to the body holding portion 12*j*' of the first holding portion 12*g*' so that the constricted portion 23 is fitted to the rib protrusion 12*k*'.

Then, by the pressing spring piece 12*m*', the body portion 21 is elastically clamped between the pressing spring piece 12*m*' and the first wall portion 12*h*' to be provisionally held by the body holding portion 12*j*'. In addition, the crank-shaped bent portion of the lead 22 is received in and held by the lead holding groove 12*d*'.

The remaining extending portion of the lead 22 is received in the lead holding groove extending portion 12*r*' formed on an inner surface of the fifth wall portion 12*l*'.

Figure 20:
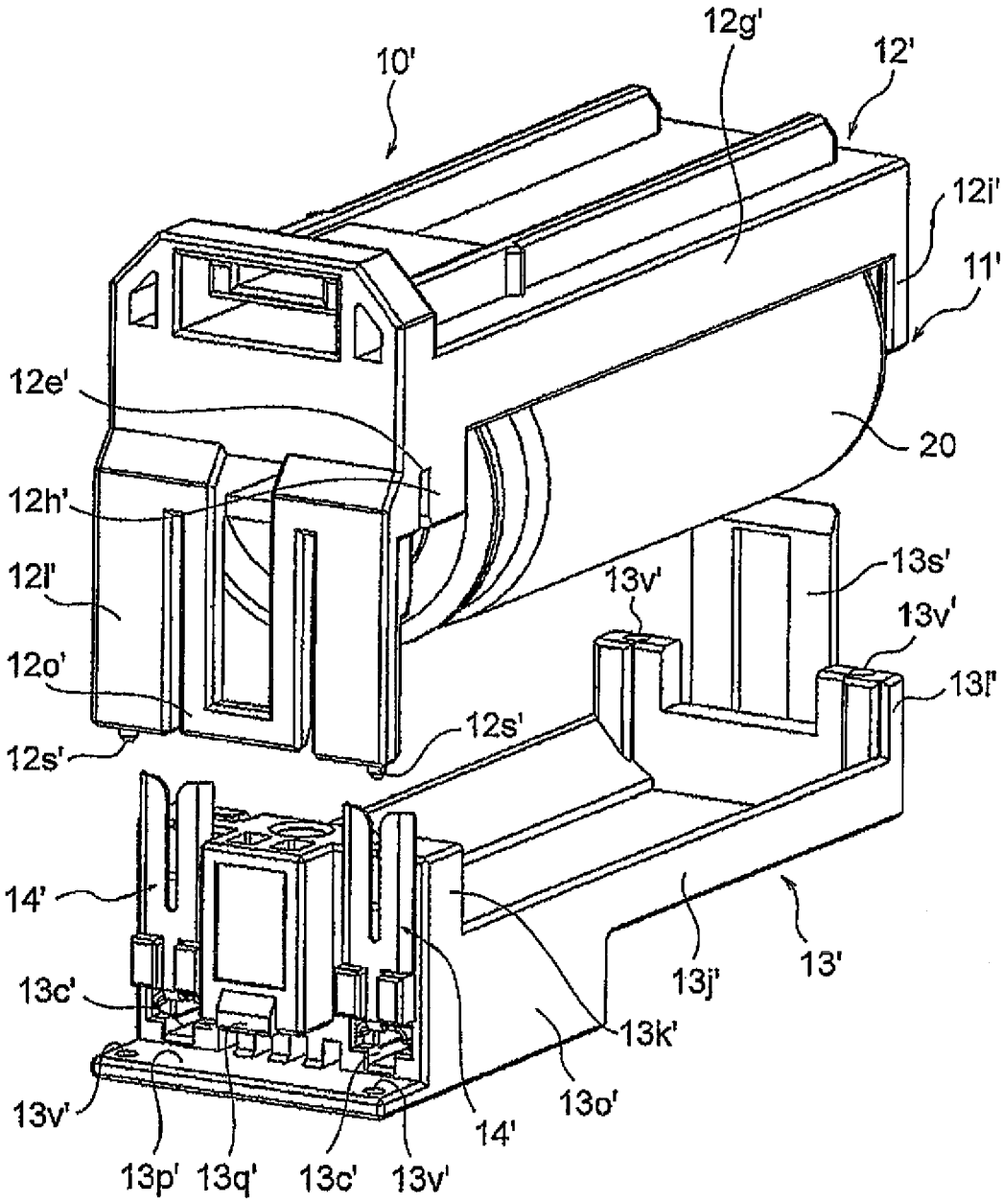
FIG. 20 is an exploded perspective view of the holder 10' in the state where the electrolytic capacitor 20 is provisionally held by a first part 12'.
Figure 21:
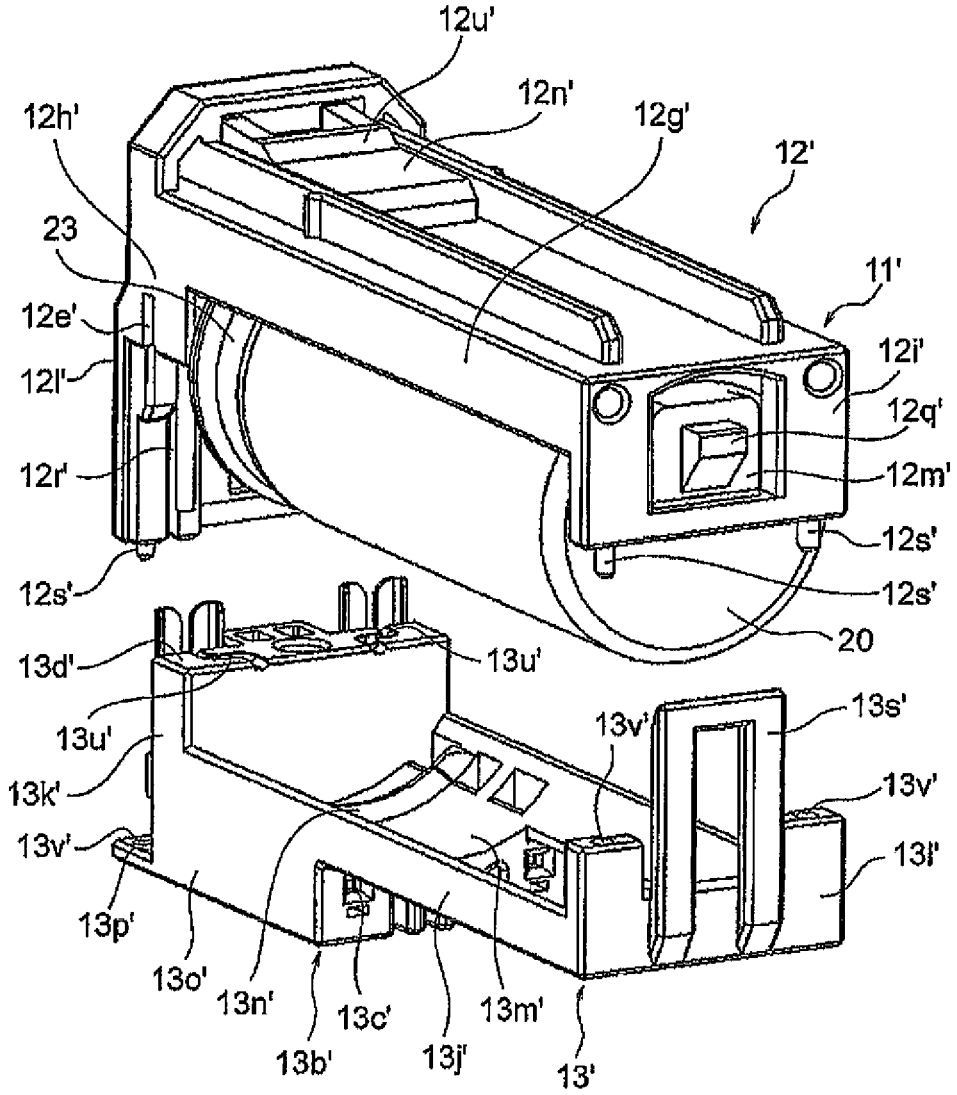
FIG. 21 is an exploded perspective view of the holder 10' in the state where the electrolytic capacitor 20 is provisionally held by the first part 12'.

Next, as illustrated in FIGS. 20 and 21, the first part 12' with the electrolytic capacitor 20 attached thereto is positioned above the second part 13' with the first terminal 14' attached thereto. The first part 12' is coupled to the second part 13' in the manner such that the lower end faces of the first wall portion 12*h*', the third wall portion 12*i*', and the fifth wall portion 12*l*' are abutted to the upper end faces of the second wall portion 13*k*', the fourth wall portion 13*l*', and the horizontal wall portion 13*p*', respectively. Then, the body portion 21 of the electrolytic capacitor 20 is clamped and held between the body holding portion 12*j*' of the first part 12' and the body holding portion 13*m*' of the second part 13' in the state where the rib protrusions 12*k*' and 13*n*' are inserted in the constricted portion 23 to be positioned.

Figure 26:
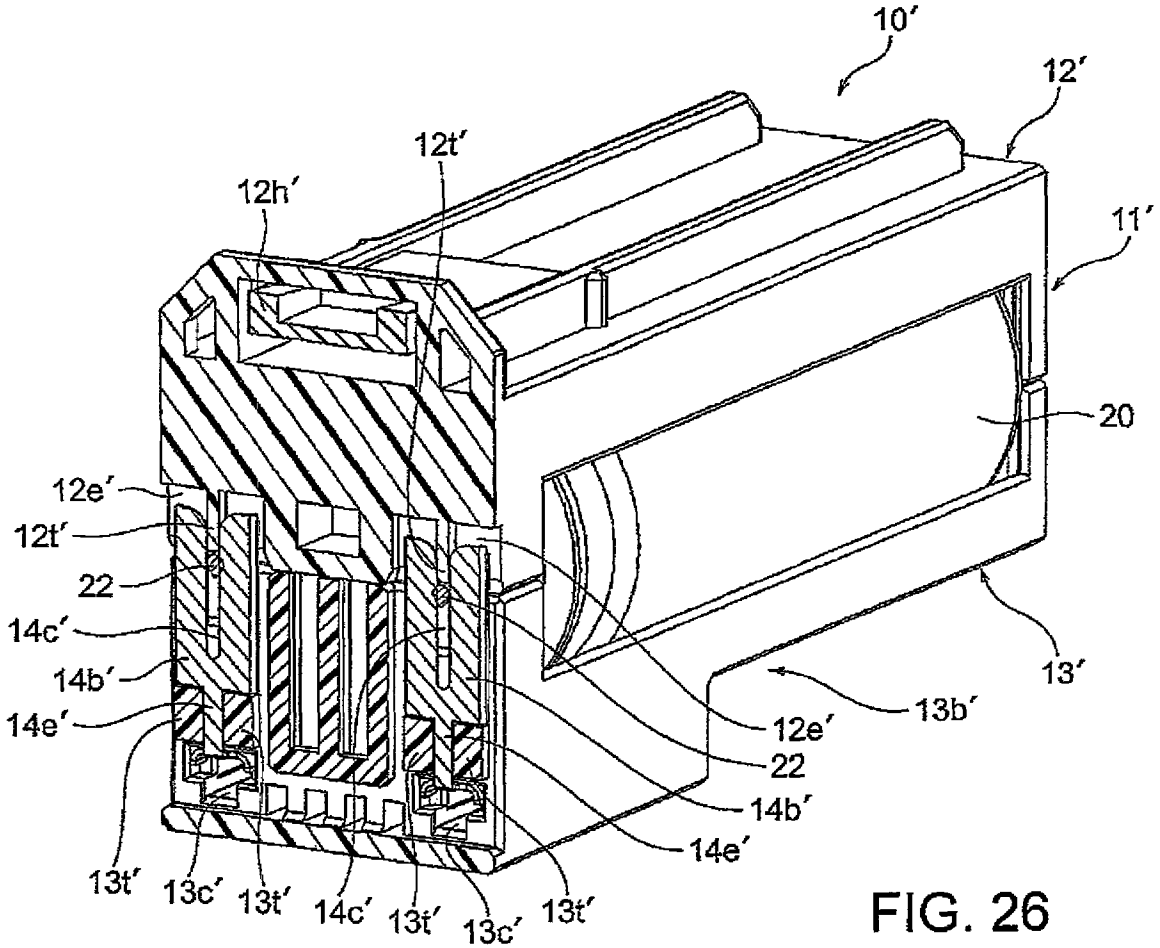
FIG. 26 is a perspective view (partially sectional view) of the holder 10'.

As illustrated in FIG. 26, the press-contacting piece 14*b*' is inserted into the press-contacting piece receiving groove 12*e*'. The lead 22 held in the lead holding groove 12*d*' by the lead pressing portion 12*t*' is pushed into the press-contacting groove 14*c*' of the press-contacting piece 14*b*' to be connected in press contact. In addition, the crank-shaped bent portion of the lead 22 is clamped and held between the lead holding groove 12*d*' of the first wall portion 12*h*' and the lead holding groove 13*u*' of the second wall portion 13*k*'.

Finally, the first engaging piece 12*o*' and the second engaging piece 13*s*' are engaged with the second engaging projecting portion 13*q*' and the first engaging projecting portion 12*q*', respectively, so that the first part 12' and the second part 13' are integrally coupled. Thus, the holder 10' is completed (see FIG. 19).

Upon coupling, the first part 12' and the second part 13' are positioned by fitting positioning projections 12*s*' formed on lower end faces of the third wall portion 12*i*' and the fifth wall portion 12*l*' into positioning holes 13*v*' formed on upper end faces of the fourth wall portion 13*l*' and the horizontal wall portion 13*p*'.

In the holder 10' formed as described above, the front peripheral surface portion of the holding body 11' including the protruding portion 13*o*' forms a fitting portion 13*b*' for a holder fitting portion 31*a*' of the board connector 30'.

Next, referring to FIGS. 17, 18, 19, 27, and 28, a structure of the board connector 30' will be described.

As illustrated in FIGS. 17, 18, 19, 27, and 28, the board connector 30' comprises a housing 31' comprising a holder fitting portion 31*a*' for fitting and attaching the holder 10' thereto, and a second terminal 32' held by the housing 31" to be brought into contact with the first terminal 14' of the holder 10'.

In the second embodiment, the board connector 30' is integrally formed with an input/output connector 41', like in the first embodiment. Accordingly, the housing 31' comprises, in addition to the holder fitting portion 31*a*', an input/output connector fitting hole 41*a*' for fitting an input/output mating connector not shown in the figure.

In the second embodiment, the input/output connector fitting hole 41*a*' and the holder fitting portion 31*a*' are opened at a front side of the housing 31'.

As illustrated in FIG. 19, the holder fitting portion 31*a*' allows the holder 10' to be fitted thereto from its rear end. The holder fitting portion 31*a*' comprises, at its bottom portion, only a part to be faced to the rear side surface of the protruding portion 13*o*' of the holder 10' and the remaining part forming a penetrating hole 31*f*'.

Thus, the bottom portion of the holder fitting portion 31*a*' is adapted so that, when the holder 10' is fitted to the holder fitting portion 31*a*', a part of the holder 10' extending rearward from the fitting portion 13*b*' protrudes rearward from the rear surface of the housing 31' through the penetrating hole 31*f*'.

The second terminal 32' penetrates the bottom portion of the holder fitting portion 31*a*' and is held thereby. The second terminal comprises one end protruding into the holder fitting portion 31*a*' to form a pin-like second contacting portion 32*a*' and the other end led out from the rear surface of the housing 31' and then perpendicularly bent downward to form a board connecting portion 32*b*' at its end (see FIGS. 17 and 27).

Next, referring to FIGS. 18, 19, 27, and 28, a method of fitting the holder 10' to the board connector 30' will be described.

First, as illustrated in FIG. 19, the holder 10' is positioned in front of the holder fitting portion 31*a*'.

Next, as illustrated in FIG. 27, the holder 10' is inserted into the holder fitting portion 31*a*' from its rear end portion.

Then, the rear end portion of the holder 10' protrudes from the rear surface of the housing 31' through the penetrating hole 31*f*' formed on the bottom portion of the holder fitting portion 31*a*'. The second contacting portion 32*a*' of the second terminal 32' is faced to a rear end opening portion of the terminal receiving hole 13*c*' of the protruding portion 13*o*' of the holder 10'.

Figure 28:
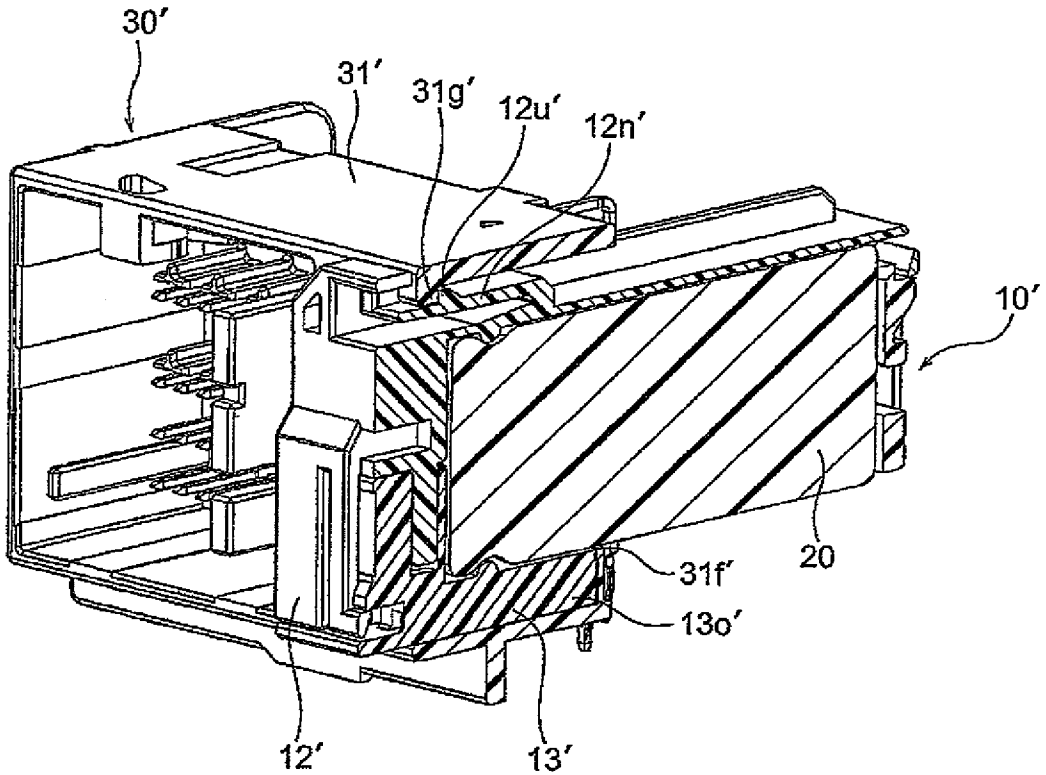
FIG. 28 is a perspective view (partially sectional view) showing a procedure of coupling the holder 10' to the board connector 30' in the state where the electrolytic capacitor 20 is coupled to the holder 10'.

Furthermore, as illustrated in FIG. 28, fitting operation is continued until the rear end face of the protruding portion 13*o*' is brought into contact with the bottom portion of the holder fitting portion 31*a*'. Then, the second contacting portion 32*a*' is inserted into the terminal receiving hole 13*c*' to be brought into elastic contact with the first contacting portion 14*a*'.

As illustrated in FIG. 28, a locking projecting portion 12*u*' formed on the upper surface of the locking piece 12*n*' is elastically engaged with a locking projecting portion 31*g*' formed on an inner surface of an upper wall of the holder fitting portion 31*a*'. Thus, the fitted and attached state is maintained.

According to the procedure described above, the holder 10' is fitted to the board connector 30'.

Next, referring to FIGS. 16 and 17, description will be made about structures of parts of the electronic circuit apparatus 5' except the board mount connector 1'.

First, a structure of the case 80' will be described.

As illustrated in FIGS. 16 and 17, the case 80' has a box shape with an opening portion 81' formed on its front side and having a size such that a peripheral outer shape of the board connector 30' is just fitted thereto. A rear half of the case forms a low profile portion which is low in height as compared with a front half.

Next, a structure of the board 60' will be described.

As illustrated in FIG. 17, the board 60' is a printed wiring board comprising circuit patterns formed on both upper and lower surfaces thereof. On the board 60', other circuit elements 70' except the electrolytic capacitor 20 are mounted. At a front edge portion, the board connector 30' is mounted so that the input/output connector fitting hole 41*a*' and the holder fitting portion 31*a* are faced frontward.

More specifically, the edge portion of the board 60' is brought into contact with a board edge mounting portion 31*d*' formed on a lower surface of the board connector 30'. The board connecting portion 42*b*' of the input/output terminal 42' and the board connecting portion 32*b*' of the second terminal 32' are inserted into through holes, not shown in the figure, of the board 60' and soldered to the circuit patterns not shown in the figure so that the board connector 30' is mounted to the board 60'.

Like in the first embodiment, the board 60' with the board connector 30' mounted on its edge portion is pushed into the opening portion 81' of the case 80' in the state where the left and the right side edges thereof are engaged with board holding grooves 88' (not shown in the figure), so that the board connector 30' is fitted to the opening portion 81'. Then, a locking projection, not shown in the figure, formed on a lower surface of the housing 31' of the board connector 30' is engaged with a locking hole, not shown in the figure, formed on a lower wall 84' of the case 80', so that the board is fixed to and held by the case 80' together with the board connector 30'. Thus, the electronic circuit apparatus 5' is completed.

Next, description will briefly be made about a method of mounting the electrolytic capacitor 20 to the board 60' (electronic circuit apparatus 5').

The electrolytic capacitor 20 is mounted to the board 60' (electronic circuit apparatus 5') as follows. In the state where the board connector 30' and the board 60' are fixed to the case 80', the holder 10' holding the electrolytic capacitor is fitted and attached to the holder fitting portion 31*a*' as described above.

When the holder 10' is fitted and attached to the holder fitting portion 31*a*', the lead 22 of the electrolytic capacitor 20 held by the holder 10' is electrically connected to the circuit pattern of the board 60' through the first terminal 14' and the second terminal 32' as described above.

Thus, according to the second embodiment, the effect similar to that of the first embodiment can be obtained. In addition, since the holder 10' is fitted and attached to the board connector 30' from outside of the case 80', it is possible to repair the electrolytic capacitor 20 due to occurrence of failure or the like without disassembling the case. Therefore, reworking can more easily be carried out as compared with the first embodiment.

INDUSTRIAL APPLICABILITY

In the embodiments described above, description has been made about the case where the present invention is used for the ECU of the airbag for automobile use. However, the present invention is not limited thereto but is applicable to various structures with the electrolytic capacitor mounted thereto.

DESCRIPTION OF THE SYMBOLS

1, 1' . . . board mount connector
5, 5' . . . electronic circuit apparatus
10, 10' . . . holder
11, 11' . . . holding member (holding portion)
12, 12' . . . first part
12*d*, 12*d*' . . . lead holding groove (lead holding portion)
12*e*, 12*e*' . . . press-contacting piece receiving groove
13, 13' . . . second part
13*b*, 13*b*' . . . fitting projecting portion (fitting portion)
14, 14' . . . first terminal
20 . . . electrolytic capacitor
30, 30' . . . board connector
31, 31' . . . housing
32, 32' . . . second terminal
41, 41' . . . input/output connector
60, 60' . . . board
70, 70' . . . circuit element
80, 80' . . . case
81, 81' . . . opening portion

The invention claimed is:

1. A board mount connector for mounting an electrolytic capacitor, comprising:

a holder comprising a fitting portion, an insulating holding portion for holding the electrolytic capacitor, and a first terminal provided in the holding portion and adapted to be electrically connected to a lead of the electrolytic capacitor; and a board connector comprising an insulating housing provided with a holder fitting portion to be fitted to the fitting portion, and a second terminal provided in the housing and adapted to connect the first terminal to a board;

wherein:

the first terminal comprises one end forming a lead connecting portion to be brought into contact with the lead and the other end arranged in the fitting portion to form a first contacting portion; and the second terminal comprising one end protruding outward from the housing to form a board connecting portion to be connected to the board and the other end arranged in the holder fitting portion to form a second contacting portion to be brought into contact with the first contacting portion.

2. The board mount connector for mounting an electrolytic capacitor according to claim 1, wherein:

the holder comprises:

a first part comprising the holding portion; and a second part comprising the fitting portion and the first terminal;

the holding portion comprising a first surface and a lead holding portion formed on the first surface and adapted to hold the lead;

the second part comprising a second surface which is faced to the first surface and on which the lead connecting portion is arranged;

the board mount connector is constructed so that, by coupling the first and the second parts to each other in the manner such that the first and the second surfaces are faced to each other, the electrolytic capacitor is held and the lead is connected to the lead connecting portion.

3. The board mount connector for mounting an electrolytic capacitor according to claim 2, wherein:

the lead connecting portion comprises a press-contacting piece comprising a press-contacting groove and protrudes from the second surface;

the lead holding portion comprising:

a lead holding groove formed on the first surface and adapted to receive and hold the lead; and a press-contacting piece receiving groove formed on the first surface to intersect with the lead holding groove and adapted to receive the press-contacting piece;

the board mount connector is constructed so that, by coupling the first and the second parts to each other in the manner such that the first and the second surfaces are faced to each other and by inserting the press-contacting piece into the press-contacting piece receiving groove, the lead is connected in press contact to the press-contacting groove.

4. The board mount connector for mounting an electrolytic capacitor according to claim 3, wherein:

the first part has a plate-like shape and is formed so that a surface opposite to the first surface is brought into contact with an end face of the electrolytic capacitor on the side provided with the lead;

the second part comprising a recessed coupling portion adapted to receive the first part, the coupling portion comprising a bottom surface forming the second surface.

5. The board mount connector for mounting an electrolytic capacitor according to claim 4, wherein the second part comprises a fixing portion for fixing the first part and the electrolytic capacitor in the state where the second part is coupled to the first part.

6. The board mount connector for mounting an electrolytic capacitor according to claim 5, wherein:

the fixing portion comprises:

a first locking piece integrally formed with the second part and adapted to be engaged with the first part; and a second locking piece integrally formed with the second part and adapted to be engaged with a constricted portion formed on a peripheral surface of the electrolytic capacitor.

7. The board mount connector for mounting an electrolytic capacitor according to claim 6, wherein:

the fitting portion is a fitting projecting portion protruding from a surface opposite to the second surface, the first contacting portion being arranged at the fitting projecting portion;

the holder fitting portion being a holder fitting hole adapted to receive the fitting projecting portion, the second contacting portion being arranged in the holder fitting hole;

the board mount connector being constructed so that the first and the second contacting portions are brought into contact with each other in the state where the fitting projecting portion is fitted to the holder fitting hole.

8. The board mount connector for mounting an electrolytic capacitor according to claim 7, wherein:

the fitting projecting portion comprises a terminal receiving hole which is opened on an end face thereof and in which the first contacting portion is arranged, the first contacting portion comprising an elastic contacting piece to be brought into elastic contact with the second contacting portion;

the second contacting portion having a pin-like shape and protruding from a bottom surface of the holder fitting hole into the holder fitting hole;

the board mount connector being constructed so that, in the state where the fitting projecting portion is fitted to the holder fitting hole, the second contacting portion is inserted into the terminal hole to be brought into contact with the first contacting portion.

9. The board mount connector for mounting an electrolytic capacitor according to claim 3, wherein:

the first and the second parts comprise a first holding portion and a second holding portion faced to each other to clamp a peripheral surface of the electrolytic capacitor, respectively, and comprise a first wall portion and a second wall portion faced to each other on the side of an end face of the electrolytic capacitor provided with the lead, respectively;

the first and the second wall portions comprise opposite surfaces forming the first and the second surfaces, respectively;

the board mount connector being constructed so that, by coupling the first and the second parts to clamp a peripheral surface of the electrolytic capacitor and by inserting the press-contacting piece into the press-contacting piece receiving groove, the electrolytic capacitor is held and the lead is connected to the lead connecting portion.

10. The board mount connector for mounting an electrolytic capacitor according to claim 9, wherein the first part comprises a provisional holding portion adapted to provisionally hold the electrolytic capacitor in the first holding portion.

11. The board mount connector for mounting an electrolytic capacitor according to claim 9, wherein the first and the second parts comprise first and second fixing portions adapted to fix each other in the state where the peripheral surface of the electrolytic capacitor is clamped therebetween.

12. The board mount connector for mounting an electrolytic capacitor according to claim 11, wherein:

the first fixing portion is an engaging piece or an engaging projection;

the second fixing portion is an engaging projection or an engaging piece adapted to be engaged with the first fixing portion.

13. The board mount connector for mounting an electrolytic capacitor according to claim 9, wherein:

the second part comprises the fitting portion on a rear surface of the second wall portion, the first contacting portion being arranged at the fitting portion;

the holder fitting portion being a holder fitting hole adapted to receive the holder, the second contacting portion being arranged in the holder fitting hole;

the board mount connector being constructed so that, in the state where the holder is fitted to the holder fitting hole, the first contacting portion in the fitting portion is brought into contact with the second contacting portion.

14. The board mount connector for mounting an electrolytic capacitor according to claim 13, wherein the holder is adapted to be fitted to the holder fitting hole from an opposite side opposite to the side comprising the fitting portion.

15. The board mount connector for mounting an electrolytic capacitor according to claim 14, wherein the holder fitting hole comprises a penetrating hole which is formed on its bottom surface and through which the holder penetrates and protrudes when the holder is fitted.

16. The board mount connector for mounting an electrolytic capacitor according to claim 15, wherein:

the second part comprises a protruding portion which is formed by a part forming the fitting portion and which protrudes outward from a peripheral surface thereof, the protruding portion comprising a terminal receiving hole opened on a bottom end face of the holder fitting hole;

the first contacting portion comprising an elastic contacting piece to be brought into elastic contact with the second contacting portion;

the second contacting portion having a pin-like shape and protruding from a bottom surface of the holder fitting hole into the holder fitting hole;

the board mount connector being constructed so that, in the state where the holder is fitted to the holder fitting hole, the second contacting portion is inserted into the terminal receiving hole to be brought into contact with the first contacting portion.

17. An electronic circuit apparatus comprising a board mounted with a circuit element and a case holding and surrounding the board;

the board being mounted with the board mount connector for mounting an electrolytic capacitor according to claim 1 in the state where the electrolytic capacitor is held, the electrolytic capacitor being mounted to the board through the board mount connector.

18. The electronic circuit apparatus according to claim 17, wherein the board mount connector is mounted to an edge portion of the board.

19. The electronic circuit apparatus according to claim 18, wherein:

the holder fitting portion is adapted so that the holder is fitted thereto in a direction parallel to a surface of the board which is mounted with the circuit element;

the electrolytic capacitor being arranged transversely in a floated state above the circuit element.

20. The electronic circuit apparatus according to claim 19, wherein the board connector is integrally formed with an input/output connector connected to the board and is attached to an opening portion formed on the case.

21. The electronic circuit apparatus according to claim 20, wherein:

the case comprises a holder holding portion adapted to receive the holder;

the holder being fitted in the holder holding portion so that the fitting portion is faced towards the opening portion;

the edge portion being mounted with the board connector so that the holder fitting portion is faced towards the inside of the case;

the board connector being fitted to the opening portion so that the fitting portion is fitted and attached to the holder fitting portion and the board is mounted in the case.

22. The electronic circuit apparatus according to claim 20, wherein the board connector is provided in the opening portion so that the holder fitting portion is faced to the outside of the case, the holder being adapted to be fitted and attached from the outside of the case.

* * * * *